US011077670B2

(12) United States Patent
Danzuka et al.

(10) Patent No.: US 11,077,670 B2
(45) Date of Patent: Aug. 3, 2021

(54) INKJET PRINTING APPARATUS AND INK FILLING METHOD

(71) Applicant: CANON KABUSHIKI KAISHA, Tokyo (JP)

(72) Inventors: Toshimitsu Danzuka, Tokyo (JP); Naoaki Wada, Yokohama (JP); Kazuki Narumi, Komae (JP); Tomoki Yamamuro, Kawasaki (JP); Hiroshi Taira, Fuchu (JP); Akiko Aichi, Tokyo (JP); Noboru Kunimine, Tokyo (JP); Taku Yokozawa, Yokohama (JP); Kazuo Suzuki, Yokohama (JP); Kazuhiko Sato, Tokyo (JP); Masataka Kato, Yokohama (JP); Shin Genta, Yokohama (JP); Hiroto Kango, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/254,505

(22) Filed: Jan. 22, 2019

(65) Prior Publication Data

US 2019/0232671 A1 Aug. 1, 2019

(30) Foreign Application Priority Data

Jan. 30, 2018 (JP) ..... JP2018-014115
Jan. 10, 2019 (JP) ..... JP2019-002777

(51) Int. Cl.
*B41J 2/175* (2006.01)
*B41J 2/165* (2006.01)

(52) U.S. Cl.
CPC ..... *B41J 2/17566* (2013.01); *B41J 2/16505* (2013.01); *B41J 2/16508* (2013.01);
(Continued)

(58) Field of Classification Search
CPC ..... B41J 2/1752; B41J 2/175; B41J 2/17523; B41J 2/17566; B41J 2/17596;
(Continued)

(56) References Cited

U.S. PATENT DOCUMENTS 6,145,978 A 11/2000 Kato et al. ..... 347/101
6,231,167 B1 5/2001 Tsuboi et al. ..... 347/65
(Continued)

FOREIGN PATENT DOCUMENTS

JP 2016-030365 3/2016
JP 2016-215593 12/2016

*Primary Examiner* — John Zimmermann
(74) *Attorney, Agent, or Firm* — Venable LLP

(57) ABSTRACT

According to an embodiment of this invention, an apparatus comprises: a detachable inktank containing ink; a subtank containing the ink supplied from the inktank; a printhead configured to discharge the ink supplied from the subtank; an ink supply path connecting the subtank to the printhead; a valve arranged on the ink supply path; a supply unit configured to supply the ink from the inktank to the subtank by repeatedly opening and closing the valve; a suction unit configured to suck the ink from the printhead; and a control unit configured to control, when the inktank is attached, the supply unit to operate for a predetermined number of times to supply the ink from the inktank to the subtank, and to subsequently control the suction unit to operate to supply the ink from the subtank to the printhead.

15 Claims, 26 Drawing Sheets

(52) U.S. Cl.
CPC ..... *B41J 2/16523* (2013.01); *B41J 2/16532* (2013.01); *B41J 2/175* (2013.01); *B41J 2/17596* (2013.01)

(58) Field of Classification Search
CPC ..... B41J 2/17563; B41J 2/16523; B41J 2/16532; B41J 2/17506; B41J 2/1652
See application file for complete search history.

(56) References Cited

U.S. PATENT DOCUMENTS 6,929,341 B2 8/2005 Mizoguchi et al. ..... 347/7
7,033,006 B2 4/2006 Ebisawa et al. ..... 347/85
8,480,216 B2 * 7/2013 Matsumoto ..... B41J 2/16523 347/85
8,602,513 B2 12/2013 Ara et al. ..... 347/7
8,789,918 B2 7/2014 Danzuka ..... 347/33
9,102,162 B2 8/2015 Watanabe et al. ... B41J 2/16532
9,278,543 B2 3/2016 Adachi et al. ..... B41J 2/17566
9,738,087 B2 8/2017 Kato et al. ..... B41J 2/17566
9,855,758 B2 1/2018 Obata et al. ..... B41J 2/175
9,902,160 B2 2/2018 Sugiyama et al. ... B41J 2/17523
9,914,305 B2 3/2018 Orihara et al. ..... B41J 2/17523
10,093,105 B2 10/2018 Shimamura et al. ..... B41J 2/17553
10,112,403 B2 10/2018 Ikebe et al. ..... B41J 2/17523
2002/0063759 A1 * 5/2002 Hirano ..... B41J 2/17503 347/85
2007/0052782 A1 * 3/2007 Lee ..... B41J 2/19 347/97
2014/0043394 A1 * 2/2014 Ishikawa ..... B41J 2/1433 347/40
2014/0146112 A1 * 5/2014 Murray ..... B41J 2/17563 347/85
2017/0326882 A1 11/2017 Okude et al. ..... B41J 2/01
2017/0361619 A1 12/2017 Arai et al. ..... B41J 2/17523
2018/0001650 A1 1/2018 Miyashita et al. ... B41J 2/17523
2018/0370243 A1 12/2018 Shimamura et al. ..... B41J 2/17553
2019/0023019 A1 1/2019 Ikebe et al. ..... B41J 2/17523

* cited by examiner

INKJET PRINTING APPARATUS AND INK FILLING METHOD

BACKGROUND OF THE INVENTION

Field of the Invention

The present invention relates to an inkjet printing apparatus and an ink filling method.

Description of the Related Art

Conventionally, an inkjet technique has been widely researched and developed since it is advantageous in that printers can be manufactured at a low cost, and an inkjet printing apparatus (to be referred to as a printing apparatus hereinafter) to which this technique is applied has become widely available in general in the form of consumer devices such as a printer, a multi-function peripheral, and the like.

In general, in such a printing apparatus, an inktank is arranged to be detachable from the printing apparatus so that ink replenishment can be performed by exchanging the inktank when the ink is consumed by the advancement of a printing operation and the inktank becomes empty. In addition, in recent years, due to a demand for the inktank capacity to be increased, there has been an increase in the number of printing apparatuses with an arrangement in which an inkjet printhead (to be referred to a printhead hereinafter), which is mounted on a carriage and moved, is connected to an inktank arranged and fixed to the printing apparatus via a tube or the like. Furthermore, there also has been an increase in the number of printing apparatuses in which a subtank is arranged between the printhead and the inktank so as to be able to continue printing even when the inktank becomes empty.

Japanese Patent Laid-Open No. 2016-030365 discloses an example of an ink initial filling method in such a printing apparatus. In this case, the initial filling is an operation to initially supply ink from an inktank to components such as a subtank, a tube, a printhead, and the like that have not been supplied with the ink yet, and fill the components with the ink.

In the printing apparatus disclosed in Japanese Patent Laid-Open No. 2016-030365, the inktank which is arranged to be detachable from the printing apparatus and the subtank which is fixed to the printing apparatus communicate with each other by a communication path formed from a hollow tube. Also, the subtank and the printhead communicate via an ink supply path whose main component is a tube, and a valve is arranged in a portion near the subtank in the ink supply path. In addition, a suction discharge mechanism formed from a cap, a suction pump, and the like is arranged to suck and discharge ink and/or air from the ink orifices of the printhead.

In a printing apparatus with such an arrangement, a choke suction method is employed to fill the printhead with ink. The choke suction method is a suction method in which the above-described valve is opened after the ink supply path on the side of the printhead is evacuated more than that of the printhead or the above-described valve by driving the above-described suction pump in a state in which the above-described valve is closed. Employing the choke suction method can minimize the amount of residual air in the evacuated region.

In the printing apparatus disclosed in Japanese Patent Laid-Open No. 2016-030365, subtank filling, that is, the operation of moving the ink from the inktank to the subtank is performed after a suction operation (to be referred to as choke suction hereinafter) by the choke suction method is repeatedly performed until the printhead is filled with ink. More specifically, the ink in the inktank is moved into the subtank by an opening and closing operation of the valve which is arranged in the ink supply path and is formed from a flexible member whose capacity can be changed.

However, the printing apparatus disclosed in Japanese Patent Laid-Open No. 2016-030365 still has the following problems.

That is, in the printing apparatus disclosed in Japanese Patent Laid-Open No. 2016-030365, the ink is made to reach the printhead by a choke suction operation of sucking out the ink from the inktank and repeating this suction operation. At this time, although the ink passes through the subtank and enters the ink supply path, the ink will enter the ink supply path while mixing with the air in the subtank since the ink amount in the subtank is small. That is, a large amount of air is mixed into the ink in the tube which is the main component of the ink supply path. In other words, even though the choke suction operation is performed to minimize the amount of air remaining in the ink supply path, a large amount of the air that is mixed into the ink, that is, bubbles will remain in the ink supply path.

In addition, in a case in which the inktank runs out of ink while the above-described choke suction operation is being repeated, almost only the air will flow into the ink supply path. Hence, although it is not discussed in Japanese Patent Laid-Open No. 2016-030365, generally, in a case in which an ink residual sensor provided in the inktank detects that there is no ink residual amount at the start of the above-described choke suction operation, an inktank exchange instruction will be displayed. However, since it is generally difficult to detect that there is no ink remaining in the inktank without leaving a small amount of ink in the inktank, a small amount of ink will remain problematically in the inktank which to be exchanged.

SUMMARY OF THE INVENTION

Accordingly, the present invention is conceived as a response to the above-described disadvantages of the conventional art.

For example, an inkjet printing apparatus and an ink filling method according to this invention are capable of filling ink without allowing air to remain in an ink supply path while minimizing remaining ink in an inktank to be exchanged.

According to one aspect of the present invention, there is provided an inkjet printing apparatus comprising: a detachable inktank which contains ink; a subtank which contains the ink supplied from the inktank; a printhead configured to discharge the ink supplied from the subtank; an ink supply path which connects the subtank to the printhead; a valve arranged on the ink supply path; a supply unit configured to supply the ink from the inktank to the subtank by repeatedly opening and closing the valve; a suction unit configured to suck the ink from the printhead; and a control unit configured to control, in a case where the inktank is attached, the supply unit to operate for a predetermined number of times to supply the ink from the inktank to the subtank, and to subsequently control the suction unit to operate to supply the ink from the subtank to the printhead.

According to another aspect of the present invention, there is provided an inkjet printing apparatus comprising: a detachable inktank which contains ink; a subtank which contains the ink supplied from the inktank; a printhead configured to discharge the ink supplied from the subtank; an ink supply path which connects the subtank to the printhead; a supply unit configured to supply the ink from the inktank to the subtank; and a suction unit configured to perform a suction operation of sucking the ink from the printhead; a first detection unit configured to detect whether an amount of the ink contained in the inktank is not less than a first threshold value; a second detection unit configured to detect whether an amount of the ink contained in the subtank is not less than a second threshold value; a count unit configured to count an amount of ink to be discharged from the printhead in a case in which the first detection unit determines that the amount of the ink contained in the inktank is less than the first threshold value and the second detection unit determines that the amount of the ink contained in the subtank is less than the second threshold value; and a control unit configured to not only in a case in which the supply unit has been operated to supply the ink from the inktank to the subtank and subsequently the suction unit has executed the suction operation to supply the ink from the subtank to the printhead when the inktank is attached, but also in a case in which the first detection unit determines that the amount of ink contained in the inktank is not less than the first threshold value, (i) in a case in which a count value of the count unit is less than a third threshold value, control the suction unit to execute the suction operation again, and (ii) in a case in which the count value is not less than the third threshold value, control the supply unit to operate again to supply the ink from the inktank to the subtank and subsequently control the suction unit to execute the suction operation again.

The invention is particularly advantageous since it is capable of preventing the entry of air from a subtank from entering the ink supply path of a printhead while minimizing as much as possible the remaining ink in the inktank to be exchanged.

Further features of the present invention will become apparent from the following description of exemplary embodiments (with reference to the attached drawings).

DESCRIPTION OF THE EMBODIMENTS

Figure 1:
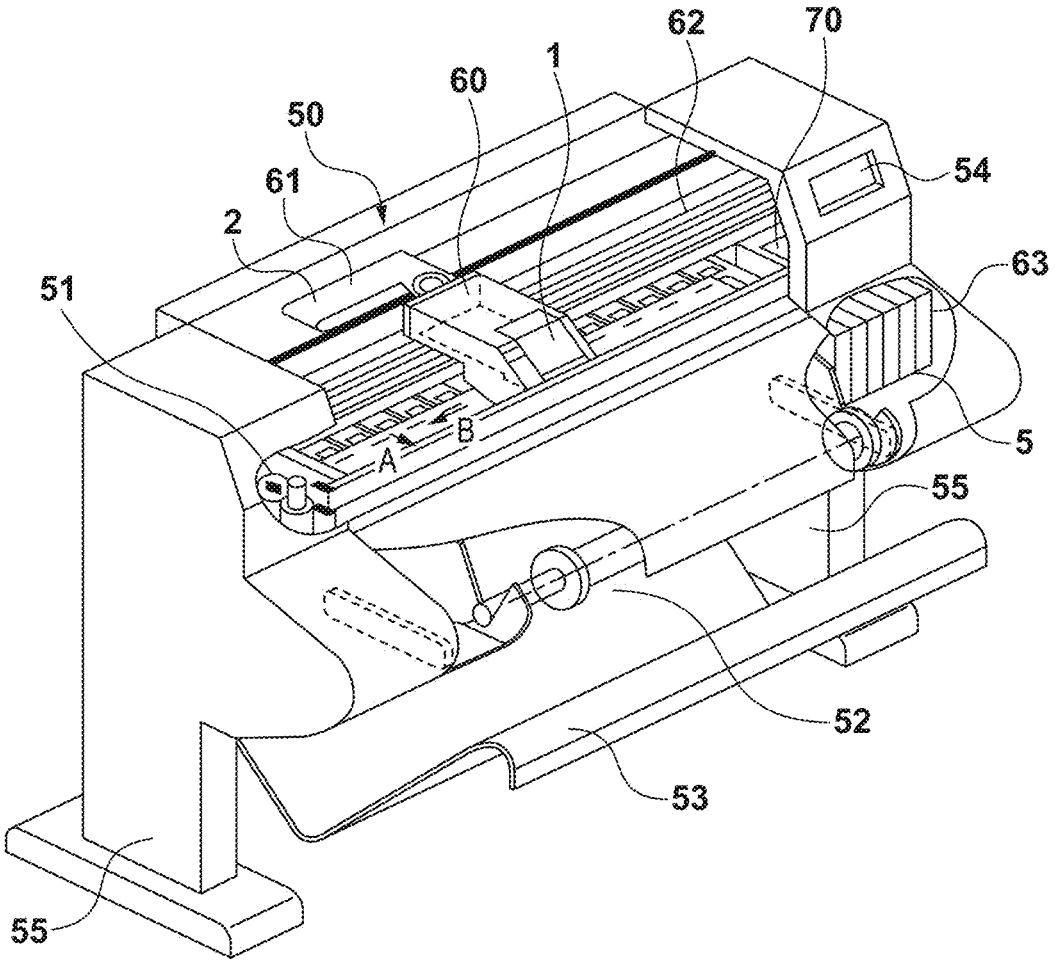
FIG. 1 is a partially cutaway perspective view showing the schematic arrangement of an inkjet printing apparatus according to an exemplary embodiment of the present invention.

Exemplary embodiments of the present invention will now be described in detail in accordance with the accompanying drawings. Note that same reference numerals are used to denote already described parts, and a repetitive description will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be broadly interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "print element (or nozzle)" generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

An embodiment of an inkjet printing apparatus will be described next. This printing apparatus is an apparatus that uses a continuous sheet (print medium) rolled into a roll and performs large-size printing of printing a B0 or A0 size image to the sheet. Note that a cut sheet may be used as a print medium to be used as a matter of course.

FIG. 1 is a partially cutaway perspective view showing the schematic arrangement of an inkjet printing apparatus according to an exemplary embodiment of the present invention.

As shown in FIG. 1, an inkjet printing apparatus (to be referred to as a printing apparatus) 50 is fixed across the upper portions of two leg portions 55 that face each other. An inkjet printhead (to be referred to as a printhead hereinafter) 1 is mounted on a carriage 60. At the time of a printing operation, a print medium set on a conveyance roll holder unit 52 is fed to a printing position, and ink droplets are discharged from nozzles of the printhead 1 while the carriage 60 is reciprocally moved in a direction (main scanning direction) indicated by an arrow B by a carriage motor (not shown) and a belt 62. When the carriage 60 moves to one end of the print medium, a conveyance roller 51 conveys the print medium for a predetermined amount in a direction (sub-scanning direction) indicated by an arrow A. An image is formed on the entire print medium by alternately repeating the printing operation and the conveyance operation in this manner. After the image formation, the print medium is cut by a cutter (not shown), and the cut print medium is stacked on a stacker 53.

An ink supply unit 63 includes inktanks 5 which are divided (are detachable from the apparatus) in accordance with ink colors such as black, cyan, magenta, and yellow, and each inktank 5 is connected to a corresponding supply tube 2. In addition, the supply tubes 2 are bundled by a tube guide 61 so as to prevent them from moving around during the reciprocal movement of the carriage 60.

The printhead 1 has, on a surface facing the print medium, a plurality of nozzle arrays (not shown) in an approximately orthogonal direction (intersecting direction) to the main scanning direction, and the supply tubes 2 are connected on a nozzle array basis.

In addition, a recovery unit 70 is arranged outside the range of the print medium in the main scanning direction, and is arranged at a position that faces the nozzle surface of the printhead 1. The recovery unit 70 executes, as needed, nozzle cleaning to suck out ink or air from the nozzle surface of the printhead 1 and a suction operation of forcibly sucking out the air accumulated inside the printhead.

An operation panel 54 is arranged on the right side of the printing apparatus 50, displays a warning message as a notification to a user when the ink runs empty in each inktank 5, and prompts the user to exchange the inktank 5.

In the printhead 1, a nozzle array is formed by arranging 1,280 ink orifices (nozzles) so that each interval between the orifices will be 1,200 dpi (dot/inch). Also, the printhead 1 includes a plurality of nozzle arrays in correspondence with the number of inks used by the printing apparatus. In addition, an electrothermal transducer is included in each ink orifice. A bubble is generated in the ink by applying an electrical signal based on a driving signal to the electrothermal transducer, and the pressure of the bubble causes an ink droplet to be discharged from the ink orifice.

Figure 2:
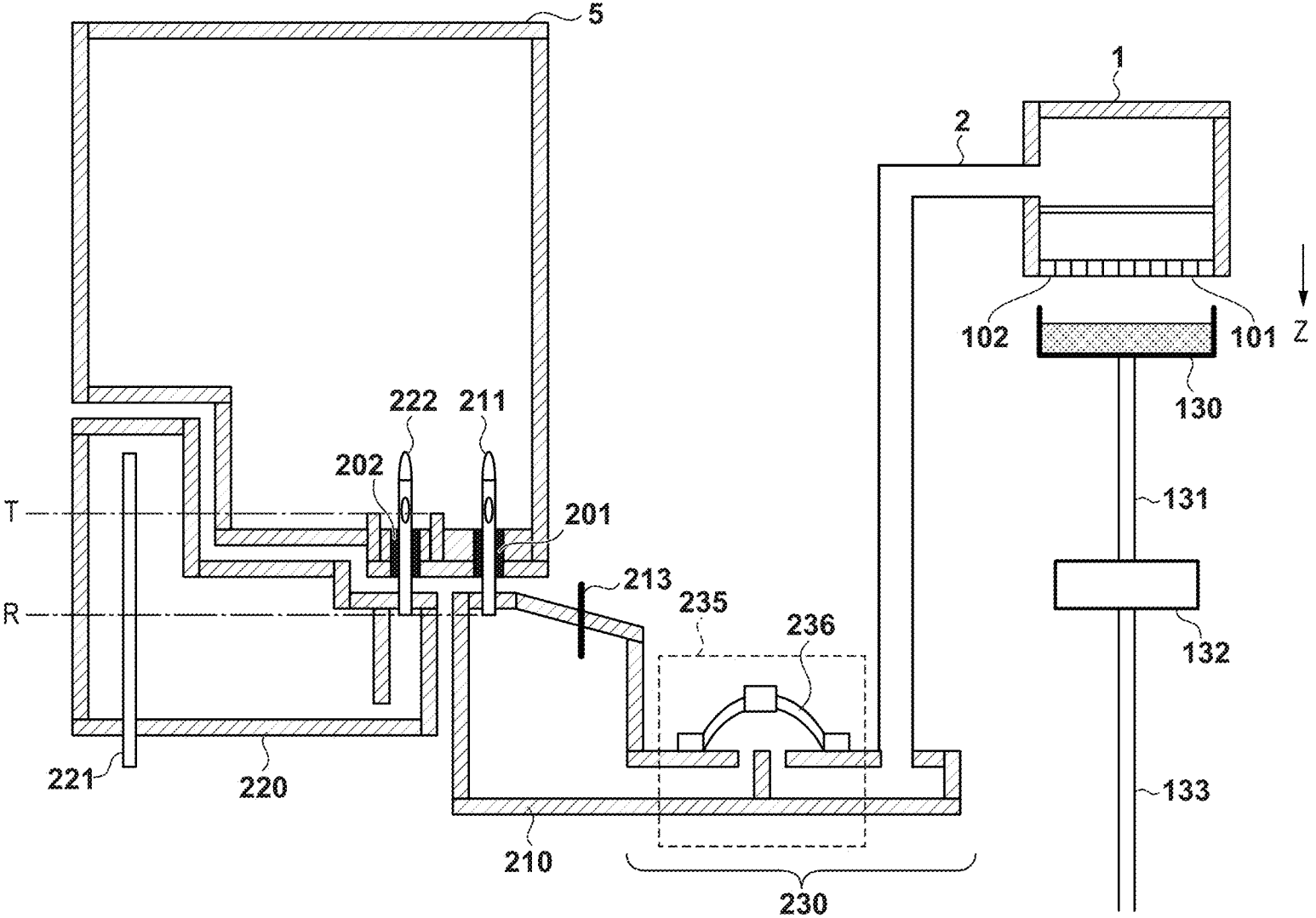
FIG. 2 is a view showing the arrangement of an ink supply subsystem of the printing apparatus shown in FIG. 1.

FIG. 2 is a view showing the arrangement of an ink supply subsystem of the printing apparatus shown in FIG. 1. As described above, although the inkjet printing apparatus 50 uses a plurality of colors of inks, since the arrangement of the ink supply subsystem is in common for the plurality of the inks, an ink supply subsystem for a single color will be illustrated here.

As shown in FIG. 2, the printhead 1 is mounted on the carriage 60 so that nozzle arrays 101 and an ink orifice surface (orifice surface) 102 face downward so as to discharge ink in a vertical direction (an arrow Z direction in FIG. 2). Also, a cap 130 for suppressing the evaporation of a solvent in the ink from the ink orifices is also included so as to face the ink orifice surface 102.

The recovery unit 70 described in FIG. 1 is formed from the cap 130, a pump tube 131, a suction pump 132, a waste ink tube 133, and the like as shown in FIG. 2. The cap 130 is connected to the suction pump 132 via the pump tube 131 and can suck and discharge ink or air from the ink orifices by driving the suction pump 132. The ink that has been sucked and discharged is contained in a maintenance cartridge (not shown) via a waste ink tube 133.

Note that the cap 130 can be reciprocally moved between a capping position and a separation position in the arrow Z direction shown in FIG. 2 by a known unit (not shown). FIG. 2 shows a case in which the cap 130 is positioned in the separation position. Also, an ink absorbing member is included in the cap 130.

Each inktank 5, which has a constant capacity and is detachable from the printing apparatus, includes two joint portions 201 and 202 at its bottom. These joint portions are connected to a first hollow tube 211 of a subtank 210 and a second hollow tube 222 of a buffer room 220. Note that each of the joint portions 201 and 202 is made of rubber, and each of the first hollow tube 211 and the second hollow tube 222 is formed by a hollow needle made of a metal.

More specifically, at the attachment of the inktank 5 to the printing apparatus, the subtank 210 communicates with the inktank 5 when the first hollow tube 211 penetrates the joint portion 201 provided at the bottom of the inktank 5. On the other hand, the buffer room 220 communicates with the inktank 5 when the second hollow tube 222 penetrates the joint portion 202 provided at the bottom of the inktank 5. Since an air communication path 221 is arranged in the buffer room 220, the interior of the inktank 5 communicates with outer air when the second hollow tube 222 penetrates the joint portion 202.

In addition, the subtank 210 and the printhead 1 communicate via an ink supply path 230 whose main component is the supply tube 2, and a valve 235 is arranged near the subtank 210 of the ink supply path 230. Note that the valve 235 includes an opening and closing unit 236 made of a flexible member.

As shown in FIG. 2, a solid tube (electrode) 213 made of a metal is arranged on the subtank 210.

Based on the arrangement described above, whether the amount of ink contained in the subtank 210 is equal to or more than a predetermined threshold value (equal to or more than a second predetermined amount) is detected by detecting a voltage value obtained when a weak current is made to flow between the solid tube 213 and the first hollow tube 211.

More specifically, in a case in which the liquid surface position of the ink in the subtank 210 is at position high enough to contact the solid tube 213 and the first hollow tube 211, the detected voltage value will be low since the solid tube 213 and the first hollow tube 211 will become conductive by the ink. In contrast, in a case in which the liquid surface position of the ink in the subtank 210 is at a low position so as not to contact the solid tube 213 and the first hollow tube 211, the detected voltage value will be high since the solid tube 213 and the first hollow tube 211 will not become conductive by the ink. That is, it is possible to detect whether the amount of ink in the subtank 210 is equal to or more than the second predetermined amount by determining whether the detected voltage value is equal to or more than a predetermined threshold value.

Note that in FIG. 2, R indicates a liquid surface position of the ink in the subtank 210 when the ink amount of the subtank 210 is the predetermined amount. The ink amount of the subtank 210 at this time is approximately the same as the maximum ink amount containable in the subtank 210.

An operation of detecting whether the amount of ink in the subtank 210 is equal to or more than the second predetermined amount based on the detected voltage value will be referred to as "subtank ink residual detection" or "subtank residual detection" hereinafter. In addition, a state in which the detected voltage value is equal to or more than a predetermined voltage value will be referred to as "residual detection off (a state in which the ink residual amount is less than the predetermined amount)", and a state in which the detected voltage value is less than the predetermined voltage value will be referred to as "residual detection on (a state in which the ink residual amount is equal to or more than the predetermined amount)". Furthermore, a state in which the result of the subtank residual detection is residual detection on will be referred to as "subtank ink residual detection on", and a state in which the result of the subtank residual detection is residual detection off will be referred to as "subtank ink residual detection off".

In addition, it is possible to detect whether the amount of ink contained in the inktank 5 is equal to or more than first predetermined amount by detecting a voltage value obtained when a weak current is made to flow between the first hollow tube 211 and the second hollow tube 222.

In the example shown in FIG. 2, in a case in which the liquid surface position of the ink in the inktank 5 is at a position higher than the position indicated by T in FIG. 2, the detected voltage will be low since the first hollow tube 211 and the second hollow tube 222 will become conductive by the ink. In contrast, in a case in which the liquid surface position of the ink in the inktank 5 is at a position lower than the position indicated by T in FIG. 2, the detected voltage will be high since the first hollow tube 211 and the second hollow tube 222 will not become conductive by the ink. That is, it is possible to detect whether the amount of ink in the inktank 5 is equal to or more than the first predetermined amount by determining whether the detected voltage value is equal to or more than a predetermined voltage value. Note that when the amount of ink in the inktank 5 is less than the first predetermined amount, there is a small amount of ink contained in the inktank 5.

An operation of detecting whether the amount of ink in the inktank 5 is equal to or more than the first predetermined amount based on the detected voltage value will be referred to as "inktank ink residual detection" or "inktank residual detection" hereinafter. Note that in the "inktank residual detection", a state in which the detected voltage is equal to or more than a predetermined value, that is, a state in which the ink residual amount of the inktank 5 is equal to or more than the first predetermined amount will be referred to as "inktank ink residual detection on". In contrast, a state in which the detected voltage is less than the predetermined value, that is, a state in which the ink residual amount of the inktank 5 is less than the first predetermined amount (a small amount of ink) will be referred to as "inktank ink residual detection off".

Figure 3:
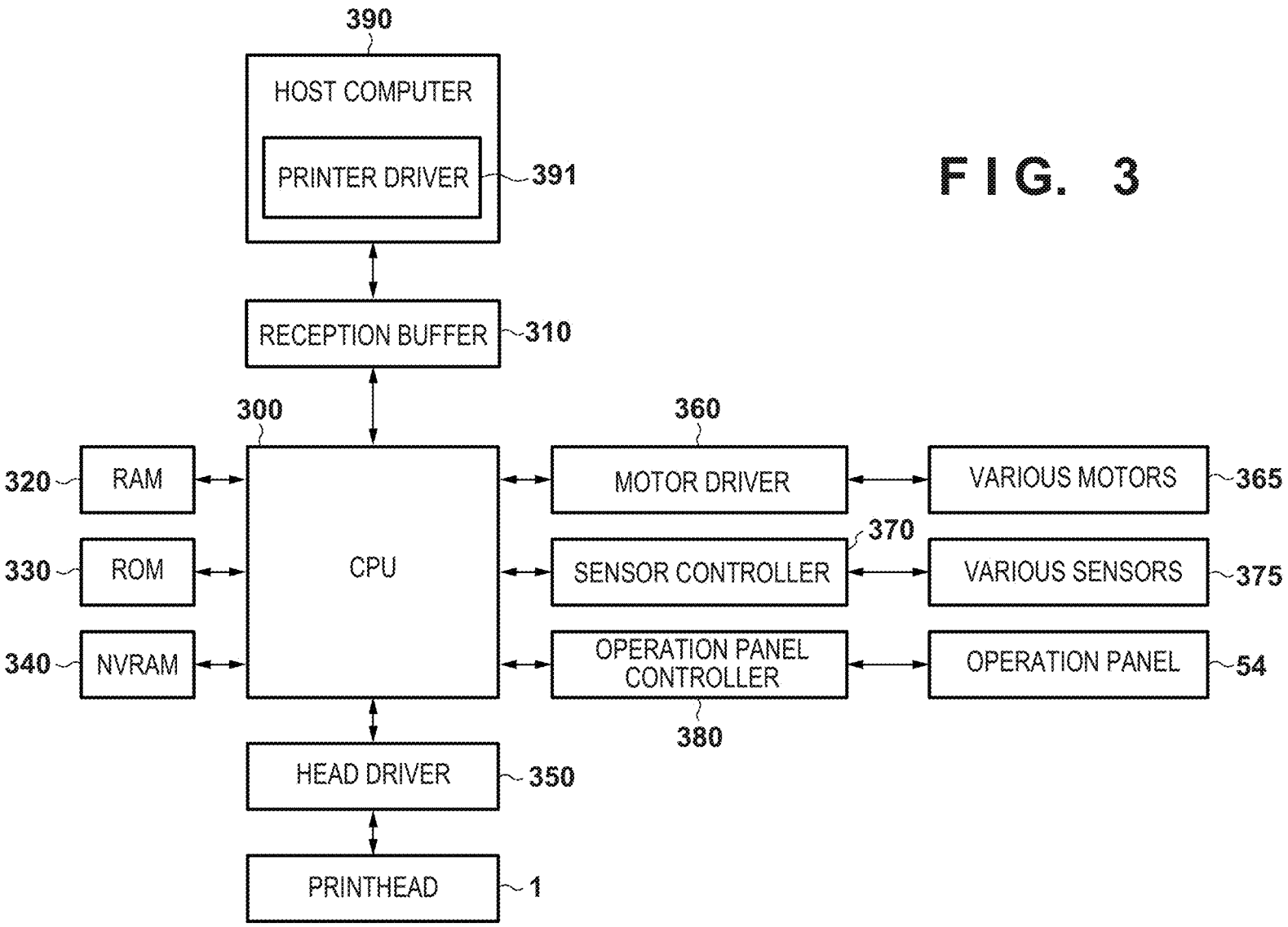
FIG. 3 is a block diagram showing the control arrangement of the printing apparatus shown in FIG. 1.

FIG. 3 is a block diagram showing the control arrangement of the printing apparatus shown in FIG. 1.

As shown in FIG. 3, the printing apparatus 50 is connected to a host computer 390, in which a printer driver 391 is installed, via a USB interface or the like. The printer driver 391 generates, in accordance with a print instruction from the user, print data from image data such as a picture or a document desired by the user, and transmits the generated print data to the printing apparatus 50. The print data or the like transmitted from the host computer 390 to the printing apparatus 50 is temporarily held in the reception buffer 310.

The printing apparatus 50 includes, a CPU 300 that controls the overall apparatus, a ROM 330 incorporating control software, a RAM 320 which is temporarily used when the printing apparatus 50 causes the control software to operate, and an NVRAM 340 that holds information even when there is no power supply. The print data or the like held in the reception buffer 310 is transferred to the RAM 320 under the management of the CPU 300 and is temporarily stored. The CPU 300 executes various kinds of operations such as computation, control, determination, setting, and the like while accessing to the RAM 320, the ROM 330, and the NVRAM 340.

In addition, the CPU 300 drives the printhead 1 via a head driver 350, controls the operation panel 54 via an operation panel controller 380, and drives various motors 365 via a motor driver 360. The various motors 365 include a carriage motor, a conveyance motor, a motor to make the cap 130 move vertically, a motor for opening and closing the valve 235, and the like. Furthermore, the CPU 300 controls various sensors 375 via a sensor controller 370.

Embodiments of ink filling sequences in a printing apparatus with an arrangement as described above will be described next in detail with reference to the drawings.

First Embodiment

An example of a filling sequence after second transportation will be described here with reference to FIGS. 4A to 8.

The filling sequence after second transportation refers to a filling sequence performed in a case in which a printing apparatus is to be transported after installation, the transportation is performed after removing the ink from the printing apparatus to prevent ink leakage, and the printing apparatus is to be filled with ink again. Note that this sequence is applicable to a case in which the printing apparatus is to be filled with ink after the ink supply subsystem has been exchanged due to a malfunction of the apparatus or the like. This sequence is started in a case in which an after second transportation flag (to be described later) is set to ON when the power key provided on an operation panel 54 of the printing apparatus is pressed and power is supplied to the printing apparatus. Note that the after second transportation flag will be set to ON after the ink is removed from the printing apparatus before the transportation.

FIGS. 4A to 5F are views showing the changes in the states of the ink supply subsystem corresponding to the advancement of the filling sequence after second transportation. Also, FIGS. 6A to 8 are flowcharts showing the filling sequence after second transportation.

When the filling sequence after second transportation is started, first, in step S601, a notification which prompts a user to attach an inktank 5 to the printing apparatus is displayed to the user by using the display of the operation panel 54. Next, in step S602, after the CPU waits for the inktank 5 to be attached to the printing apparatus and confirms the attachment, the process advances to step S603, and the display of the notification prompting inktank attachment is set to OFF. Note that a known electrical connection detection arrangement or the like is used to confirm the attachment of the inktank 5.

Figure 4A:
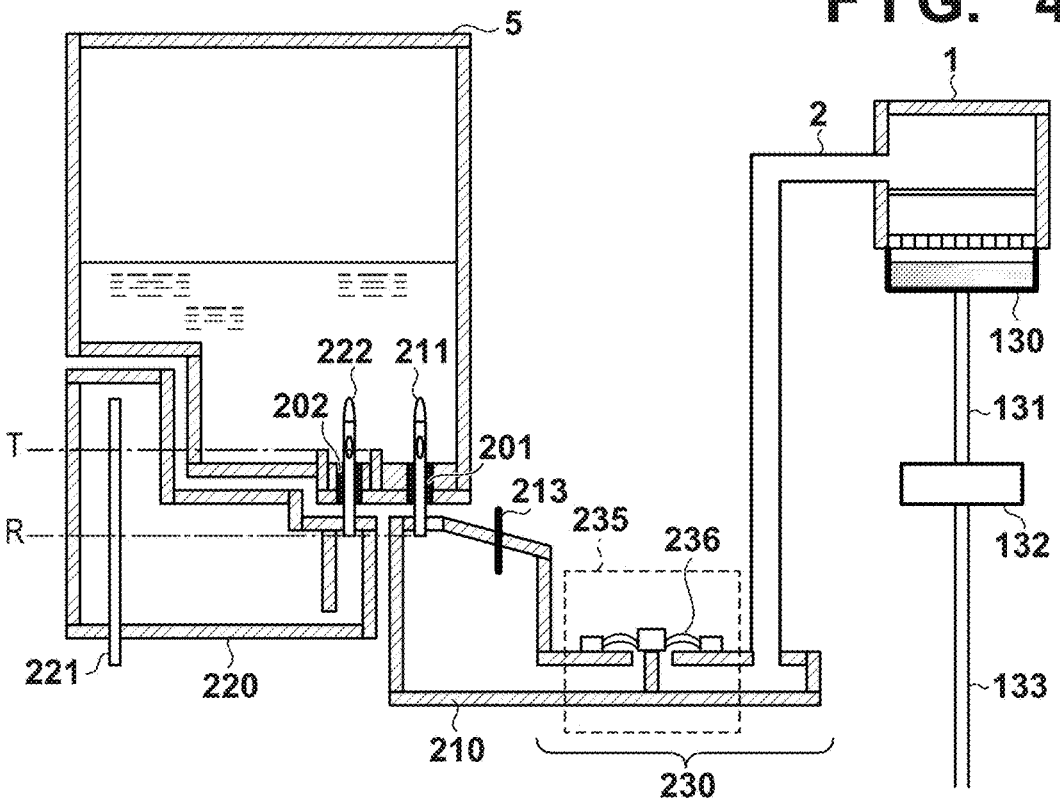
FIGS. 4A, 4B, 4C, 4D, and 4E are views showing the changes in the state of the ink supply subsystem corresponding to the advancement of a filling sequence after second transportation according to the first embodiment.

FIG. 4A shows the state of the ink supply subsystem at the point when a not new (used) inktank 5 is attached to the printing apparatus. Although it is also shown in FIG. 4A, note that a cap 130 is to be positioned at a capping position until the timing at which the inktank 5 is to be attached and that a valve 235 is closed. Also, assume that a first hollow tube 211 and a second hollow tube 222 both have an interior diameter of about 1 mm and a length of about 30 mm, and that a gas-liquid exchange does not occur within these hollow tubes. Hence, the ink in the inktank 5 will not flow out into a buffer room 220 or a subtank 210 just by attaching the inktank 5 to the printing apparatus. This will not be the case, however, if there is a difference between the internal pressure of the inktank 5 and the outer air pressure of the installation environment of the printing apparatus.

When the display of the notification prompting inktank attachment is set to OFF, the process advances to step S700, and a subtank filling sequence is executed. The subtank filling sequence will be described with reference to the flowcharts shown in FIG. 4A to FIG. 7.

When the subtank filling sequence is started, in step S701, the values of counters N and F are reset to "0". Note that the counters N and F are counters for counting the number of opening and closing times of the valve 235.

Subsequently, the process advances to step S702, and the valve 235 is set to a closed state.

Figure 4B:
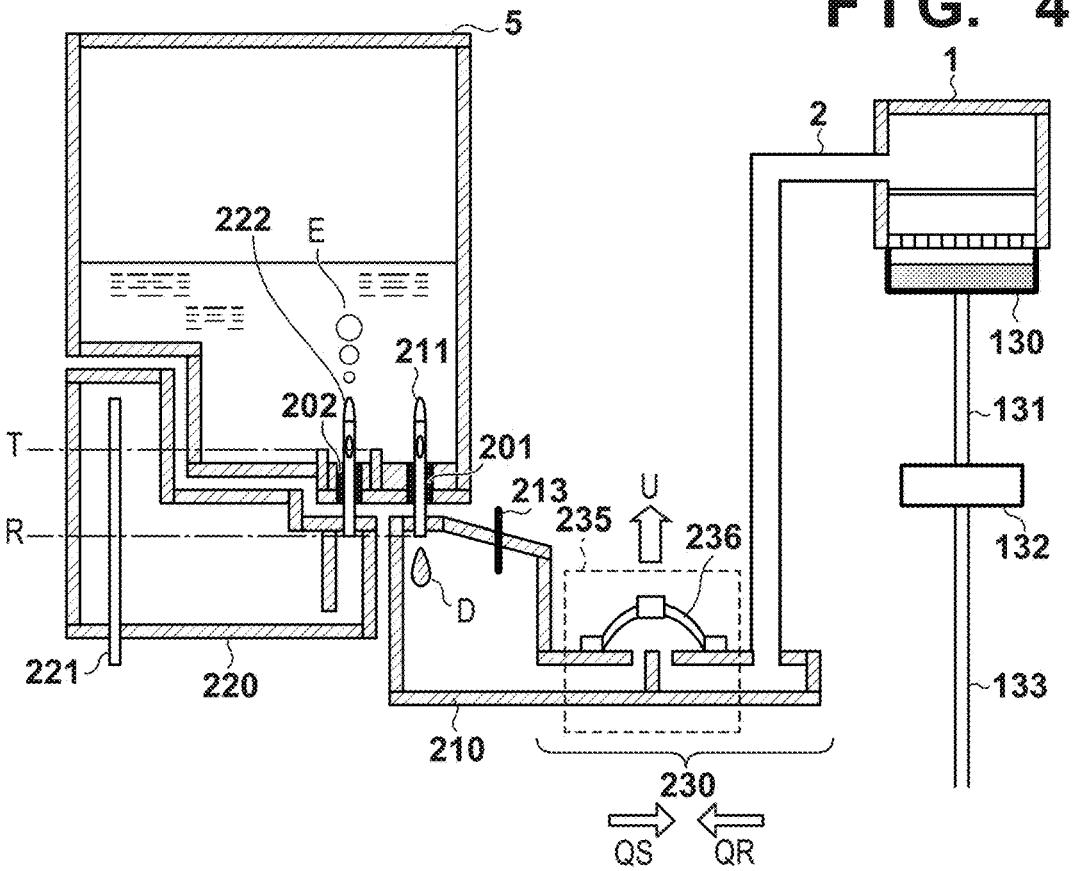

FIG. 4B shows a state in which an opening and closing unit 236 of the valve 235 is open. At this time, the valve 235 is opened by driving an elevation mechanism (not shown) to lift the opening and closing unit 236 of the valve 235 in a direction indicated by an arrow U in FIG. 4B. When the valve 235 is opened, the air in an ink supply path 230 nearer to the subtank 210 than the valve 235 is sucked toward a direction of an arrow QS in FIG. 4B, and air in the ink supply path 230 nearer to a printhead 1 than the valve 235 is sucked toward an arrow QR direction in FIG. 4B. The subtank 210 is evacuated by the air suction operation in the QS direction, and in order to eliminate this evacuation, the ink in the inktank 5 moves into the subtank 210 via the first hollow tube 211 (see D in FIG. 4B). At this time, an amount of air in the buffer room 220, corresponding to the amount of the ink that moved into the subtank 210, moves into the inktank 5 via the second hollow tube 222 (see E in FIG. 4B). Furthermore, an amount of outer air corresponding to the amount of the air that moved into the inktank 5 flows into the buffer room 220 via an air communication path 221.

In the ink supply path 230, a portion nearer to the subtank 210 than the valve 235 will be referred to as a portion on an "upstream side from the valve", and a portion nearer to the printhead 1 than the valve 235 will be referred to as a portion on a "downstream side from the valve".

In step S703, the valve 235 is set to the closed state.

Figure 4C:
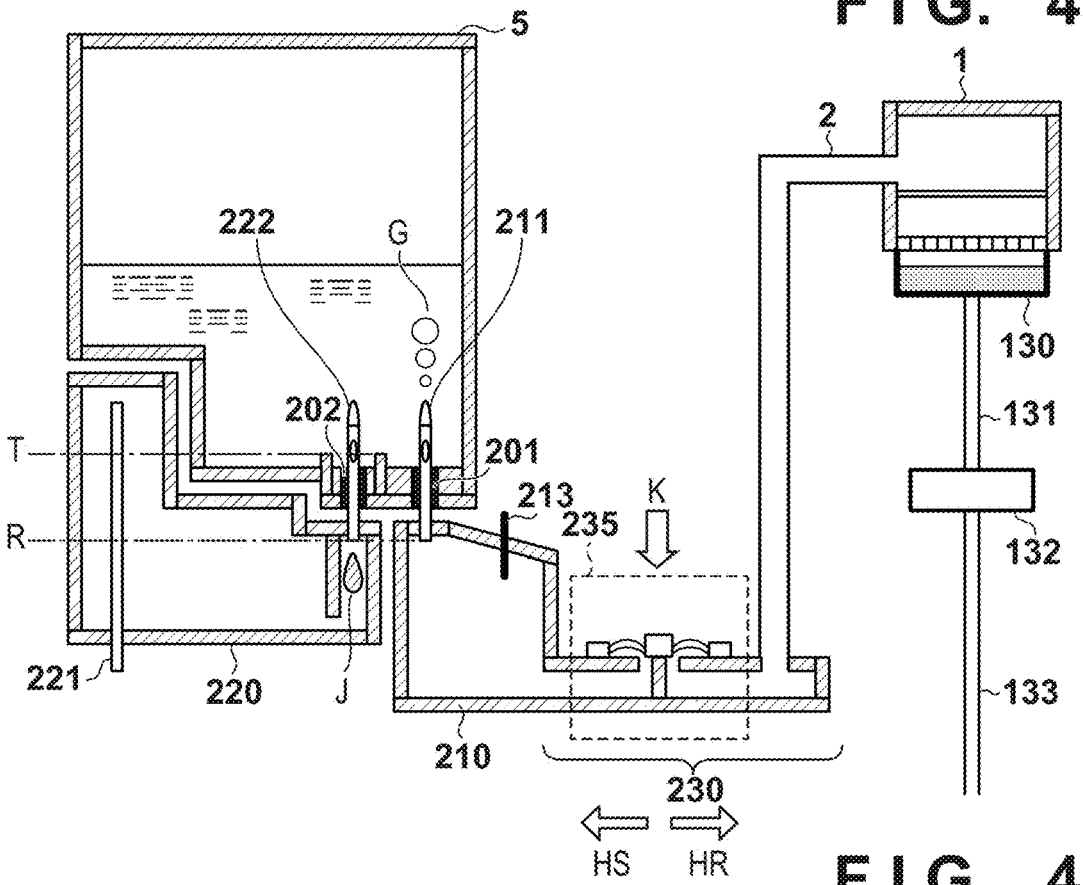

FIG. 4C shows a state in which the opening and closing unit 236 of the valve 235 is closed. At this time, the valve 235 is closed by driving the elevation mechanism (not shown) to press down the opening and closing unit 236 of the valve 235 in a direction indicated by an arrow K in FIG. 4C. When the valve 235 is closed, the air in the valve 235 is pushed out to the side of the subtank 210 (an arrow HS direction in FIG. 4C) and the side of the printhead 1 (an arrow HR direction in FIG. 4C). The subtank 210 is pressurized when the air is pushed out in the HS direction, and in order to eliminate this pressurization, the air in the subtank 210 moves into the inktank 5 via the first hollow tube 211 (see G in FIG. 4C). At this time, an amount of ink in the inktank 5, corresponding to the amount of the air that moved into the inktank 5, moves into the buffer room 220 via the second hollow tube 222 (see J in FIG. 4C). Furthermore, air corresponding to the amount of ink that moved into the buffer room 220 flows out to the outside of the buffer room 220 via the air communication path 221.

That is, by the opening and closing operation of the valve 235 performed in steps S702 and S703, the ink in the inktank 5 moves into the subtank 210, and the air in the subtank 210 moves into the inktank 5. This kind of opening and closing operation of the valve 235 will be also referred to as a subtank filling operation hereinafter. The operation will be executed. In addition, along with this subtank filling operation, the air in a portion on the downstream side from the valve in the ink supply path 230 will reciprocally move in the arrow QR direction in FIG. 4B and the arrow HR direction in FIG. 4C.

Subsequently, the process advances to step S710, and the inktank residual detection described above is executed. Here, if the result of the inktank residual detection is residual detection on (YES), the process advances to step S711, and the value of the counter N is incremented ("+1"). In contrast, if the result of the inktank residual detection is residual detection off (NO), the process advances to step S712, and the value of the counter F is incremented ("+1"). In this manner, in a case in which the subtank filling operation is performed when there is a sufficient amount of ink in the inktank 5, more specifically, when the liquid surface position of the ink in the inktank 5 is higher than the position indicated by T in FIG. 2, the value of the counter N is incremented. In contrast, in a case in which the subtank filling operation is performed when the amount of ink in the inktank 5 is less than a small amount, more specifically, when the liquid surface position of the ink in the inktank is lower than the position indicated by T in FIG. 2, the value of the counter F is incremented.

After the process of step S711 or step S712 ends, the process advances to step S720, and the subtank residual detection described above is executed. Here, if the result of the subtank residual detection is subtank ink residual detection off (NO), the process advances to step S730, and whether the value of the counter F is equal to or more than Fth is determined. Here, if F<Fth, that is, if the value of the counter F is less than Fth (less than the threshold value), the process advances to step S740, and whether the value of the counter N is equal to or more than the Nth is determined. Here, if the N<Nth, that is, if the value of the counter N is less than Nth (less than the threshold value), the process returns to step S702, and the subtank filling operation is executed again. In this manner, the subtank filling operation is repeated until it becomes one of a state in which the result of the subtank residual detection is residual detection on, a state in which the value of the counter F is equal to or more than Fth, and a state in which the value of the counter N is equal to or more than Nth.

Note that the more specific values of Fth and Nth are "20" and "100", respectively, in this subtank filling sequence.

In step S740, N≥100, that is, in a case in which the value of the counter N is equal to or more than 100, the process advances to step S741. A state in which the value of the counter N is equal to or more than 100 represents a state in which the result of the subtank residual detection is not residual detection on even though the subtank filling operation has been executed hundred or more times in a state in which there is a sufficient amount of ink in the inktank 5. The cause of the occurrence of such a phenomenon is assumed here to be a defect in the attachment of the inktank 5 to the printing apparatus, and in step S741, a message to prompt the user to detach the inktank 5 from the printing apparatus will be displayed on the display unit of the operation panel 54.

Subsequently, the process advances to step S742, and the CPU waits until the inktank 5 is removed by the user. If the detachment of the inktank 5 is confirmed here, the process advances to step S743, the display of the message prompting the user to detach the inktank 5 is turned off, and the process subsequently returns to step S701. The process is restarted from step S701.

In step S730, if F≥20, that is, if the value of the counter F is equal to or more than 20, the process advances to step S731. Note that a state in which the value of the counter F is equal to or more than 20 represents a state in which the subtank filling operation has been executed twenty or more times in a state in which the there is a small amount or less of an ink amount in the inktank 5, and there is no ink that can be moved to the subtank 210 in the inktank 5. Hence, in step S731, a message to prompt the user to exchange the inktank 5 is displayed on the display unit of the operation panel 54.

Subsequently, the process advances to step S732, and the CPU waits for the user to exchange the inktank 5. If it is confirmed that the inktank 5 has been exchanged, the process advances to step S733, the display of the message prompting the user to exchange the inktank is turned off, and the process subsequently returns to step S701. The processing is restarted from step S701.

Also, in a case in which it is determined in step S720 that the result of the subtank residual detection is residual detection on (YES), the process advances to step S790. In step S790, after the count value of a subtank counter (to be described later) is reset to "0", the subtank filling sequence ends.

In summary, the subtank filling sequence is a sequence in which the subtank filling operation is repeated until the result of the subtank residual detection is residual detection on, and the count value of the subtank counter (to be described later) is reset to zero when the result of the subtank residual detection is residual detection on.

Figure 4D:
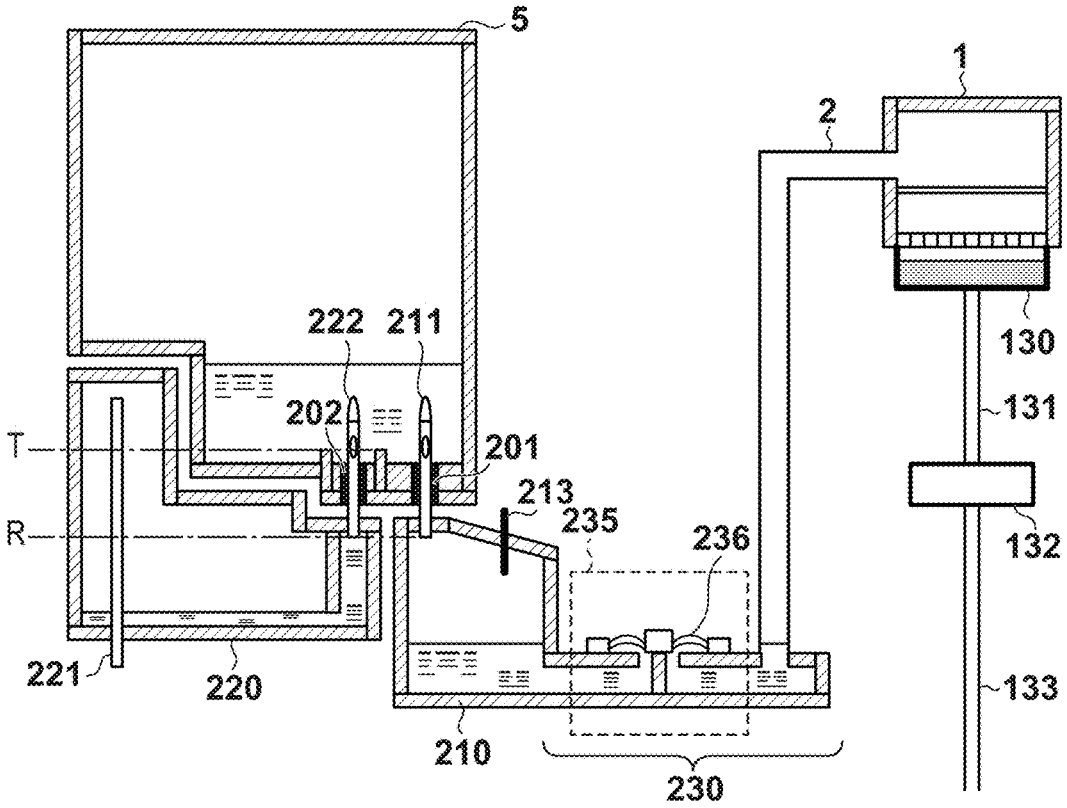
Figure 4E:
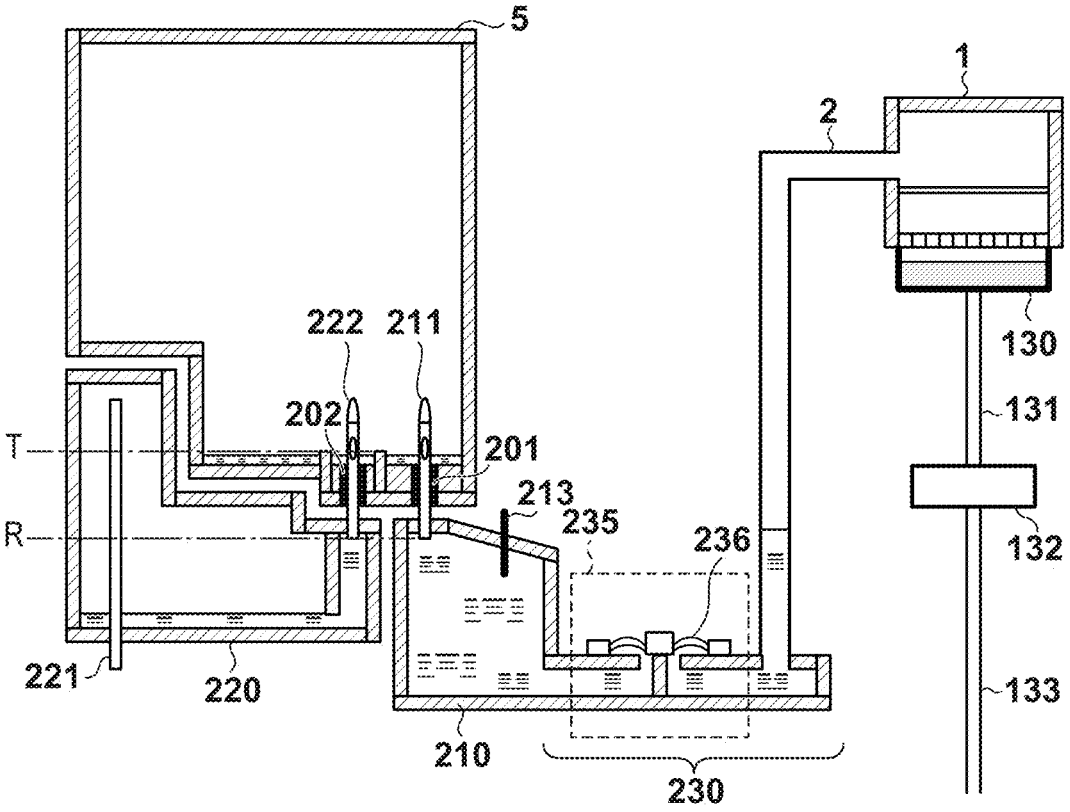

FIG. 4E shows a state in which the result of the subtank residual detection is residual detection on. That is, as shown in FIG. 4E, since the subtank filling operation is performed until the liquid surface position of the ink in the subtank 210 is at a position indicated by R, the amount of ink in the subtank 210 will be an approximate maximum amount of ink containable in the subtank 210. The approximate maximum amount of ink containable in the subtank 210 will be referred to as an "approximately filled-up amount" hereinafter.

FIG. 4D shows the state of ink movement during the execution of the subtank filling sequence. When the valve 235 is opened in a state as shown in FIG. 4D, the ink in a portion on the upstream side from the valve in the ink supply path 230 is sucked in the arrow QS direction in FIG. 4B. Also, simultaneously, the ink in a portion on the downstream side of the valve in the ink supply path 230 is sucked in the arrow QR direction in FIG. 4B. The subtank 210 is evacuated by the ink suction operation in the QS direction, and in order to eliminate this evacuation, the ink in the inktank 5 moves into the subtank 210 via the first hollow tube 211 (see D in FIG. 4B). At this time, an amount of ink in the buffer room 220, corresponding to the amount of the ink that moved into the subtank 210, moves into the inktank 5 via the second hollow tube 222. Note that there is no bubble generation as that shown by E in FIG. 4B. Furthermore, an amount of outer air corresponding to the amount of the ink that moved into the inktank 5 flows into the buffer room 220 via an air communication path 221.

In addition, when the valve 235 is closed in the state as shown in FIG. 4D, the ink in the valve 235 is pushed out to the side of the subtank 210 (the arrow HS direction in FIG. 4C) and the side of the printhead 1 (the arrow HR direction in FIG. 4C). The subtank 210 is pressurized by the ink pushout in the HS direction, and in order to eliminate this pressurization, the air in the subtank 210 moves into the inktank 5 via the first hollow tube 211 (see G in FIG. 4C). At this time, an amount of ink in the inktank 5, corresponding to the amount of air that moved into the inktank 5, moves into the buffer room 220 via the second hollow tube 222. Furthermore, air corresponding to the amount of air that moved into the buffer room 220 flows out to the outside of the buffer room 220 via the air communication path 221.

By the opening and closing operation of the valve 235 as described above, the ink in a portion on the downstream side of the valve in the ink supply path 230 reciprocally moves in the arrow QR direction in FIG. 4B and the arrow HR direction in FIG. 4C. However, the distance of this reciprocal movement is shorter than the distance of the reciprocal movement of the air at the point when the area on the downstream side of the valve in the ink supply path 230 is filled with air at the start of the opening and closing operation of the valve 235. In addition, the amount of ink (to be referred to as the subtank filling efficiency hereinafter) that moves from the inktank 5 to the subtank 210 per one opening and closing operation of the valve 235 is larger than that at the start of the closing and opening operation of the valve 235. In other words, the subtank filling efficiency is increased.

The description will continue by referring back to FIGS. 6A to 6C. When the subtank filling sequence in step S700 ends, the process advances to step S800, and a suction operation A sequence is executed. The suction operation A sequence will be described with reference to the flowchart shown in FIG. 8.

When the suction operation A sequence is started, the valve 235 is opened in step S801. Next, the process advances to step S802, and the suction operation A is executed. More specifically, a suction pump 132 is driven for ten seconds. The ink in the subtank 210 is sucked into a supply tube 2 by the suction operation A.

Note that since there is a sufficient amount of ink contained in the subtank 210 at this time, a state in which the ink will enter inside the supply tube 2 while mixing with the air in the subtank 210 as described above will not occur. That is, mixing of bubbles into the ink supply path 230 will be prevented. Also, since the suction operation A will be executed regardless of the result of the inktank residual detection even when the result of the inktank residual detection is residual detection off, it can prevent a small amount of ink from remaining problematically in the inktank to be exchanged as described above.

At this time, if a sufficient amount of ink is contained in the inktank 5, approximately the same amount of ink as the amount of ink that was sucked into the supply tube 2 will flow from the inktank 5 into the subtank 210 via the first hollow tube 211. In accordance with this, the corresponding amount of air will flow into the inktank 5 via the air communication path 221, the buffer room 220, and the second hollow tube 222. However, if the suction operation A is executed in the state as shown in FIG. 4E, that is, a state in which there is just a small amount of ink contained in the inktank 5, initially the ink and subsequently the air will flow into the subtank 210. Thus, at the end of the suction operation A, the state of the ink supply subsystem becomes as that shown in FIG. 5A.

Figure 5A:
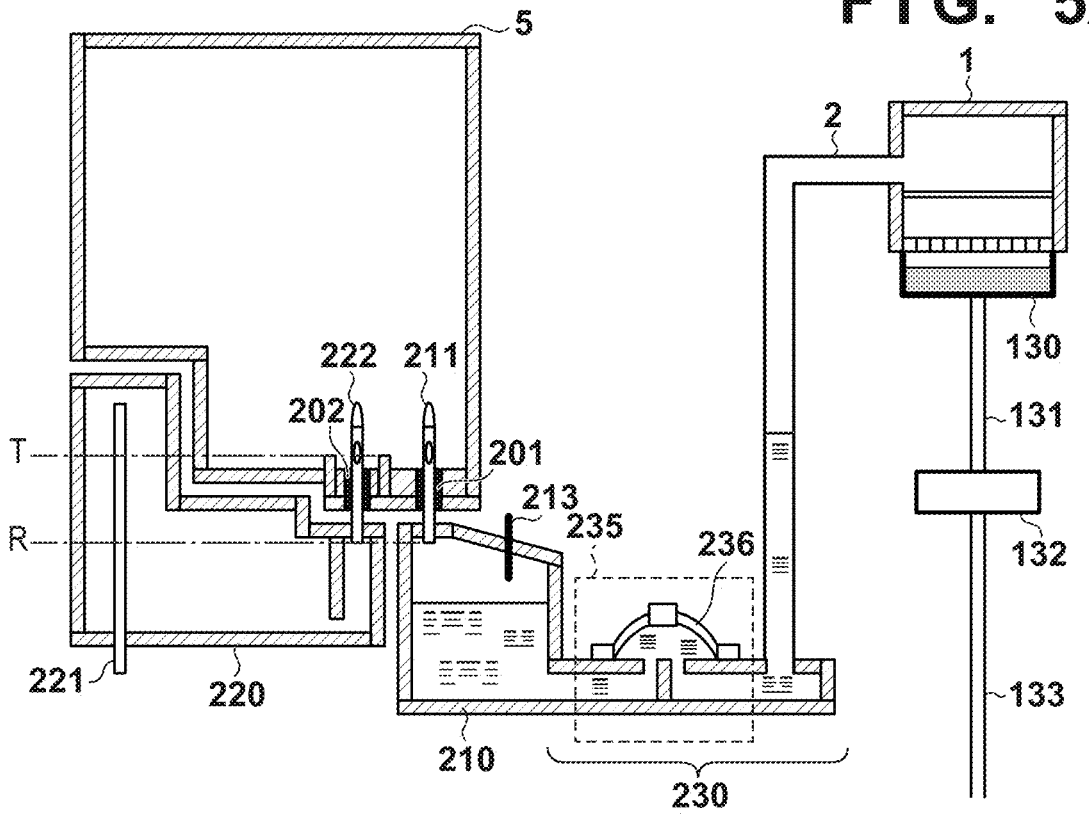
FIGS. 5A, 5B, 5C, 5D, 5E, and 5F are views showing the changes in the state of the ink supply subsystem corresponding to the advancement of the filling sequence after second transportation according to the first embodiment.

As shown in FIG. 5A, at the end of the suction operation A, the amount of ink remaining in the inktank 5 is approximately zero, and the amount of ink contained in the subtank 210 becomes less than the approximately filled-up amount.

After the suction operation A in step S802 ends, the process advances to step S803, and the inktank residual detection is executed. If the result of the inktank residual detection is determined to be residual detection off here (NO), the process advances to step S804. Note that in a state as shown in FIG. 5A, since the amount of ink remaining in the inktank 5 is approximately zero, that is, since the liquid surface position of the ink in the inktank 5 is at a position lower than that indicated by T, the result of the inktank residual detection will be residual detection off.

In step S804, the subtank residual detection is executed. If the result of the subtank residual detection is determined to be residual detection off here (NO), the process advances to step S805. Note that in a state as shown in FIG. 5A, since the amount of the ink in the subtank 210 is smaller than the approximately filled-up amount, more specifically, since the liquid surface position of the ink in the subtank 210 is lower than the position indicated by R, the result of the subtank residual detection will be residual detection off.

In step S805, a suction amount A by the suction operation A is added to the subtank counter for counting how much smaller the amount of ink in the subtank 210 is than the approximately filled-up amount. Note that the subtank counter counts the ink amount or air amount that is discharged or sucked and discharged from the ink orifices of the printhead 1 in a state of the inktank ink residual detection off and the subtank ink residual detection off. Then, how much the amount of ink in the subtank 210 is smaller than the approximately filled-up amount is grasped by using this count value.

Note that with respect to the suction operation, it is difficult to grasp at which point during the suction operation the change to the state of the inktank ink residual detection off and the subtank ink residual detection off has occurred. In other words, it is difficult to grasp how much of the ratio of the suction amount by this suction operation has contributed to reducing the amount of ink in the subtank 210 to a state in which it is smaller than the approximately filled-up amount. Therefore, in the suction operation A sequence, if the state of the inktank ink residual detection off and the subtank ink residual detection off is determined after the end of the suction operation, the entire suction amount by the suction operation will be added to the subtank counter.

The suction operation A sequence will end after the process of step S805 ends.

Note that if it is determined in step S804 that the result of the subtank residual detection is residual detection on (YES), the suction operation A sequence will end. Also, if it is determined in step S803 that the result of the inktank residual detection is residual detection on (YES), the suction operation A sequence will end as it is. That is, if the state of the inktank ink residual detection off and the subtank ink residual detection off is determined after the end of the suction operation A, the suction amount A of the suction operation A will be added to the subtank counter. Otherwise, the suction operation A sequence will end without any further processes.

The description will continue by referring back to FIGS. 6A to 6C. After the suction operation A sequence ends in step S800, the process advances to step S809, and the value of a counter M for counting the number of the times the suction operation A sequence has been executed is reset to "0".

Subsequently, the process advances to step S810, and inktank residual detection is executed again. Here, if the result is residual detection off (NO), the process advances to step S820.

In step S820, the subtank residual detection is executed. If the result is residual detection off (NO), the process advances to step S821 and the valve 235 is closed. This is because the ink that has been sucked into the middle of the supply tube 2 may flow backward into the subtank 210 due to the effect of gravity during a comparatively long period of time required for the exchange of the inktank 5, which is to be subsequently performed, if the valve 235 is not closed.

This reason will be described in more specific detail here.

At the end of the suction operation A in step S802, there is a possibility that menisci may not be formed on the ink orifices of the printhead 1. If the menisci are not formed on the ink orifices of the printhead 1, the air or the ink in the cap 130 can pass through the ink orifices and move into the printhead 1. If the air or the ink in the cap 130 is capable of moving into the printhead 1, the ink in the supply tube 2 which is positioned in a more upward vertical direction than the liquid surface position of the ink in the subtank 210 will move in the downward vertical direction due to the effect of gravity. That is, the ink in the supply tube 2 will flow backward into the subtank 210. At this time, if the suction pump 132 has an arrangement to communicate the interior of the cap 130 with outer air while the operation is stopped, the ink in the supply tube 2 will flow backward until its liquid surface position is at approximately the same position as the liquid surface position of the ink in the subtank 210. A state in which the ink in the supply tube 2, which is positioned in a more upward vertical direction than the liquid surface position of the ink in the subtank 210, flows backward into the subtank 210 due to the effect of gravity will be referred to as "ink falling" hereinafter.

However, at this time, the possibility of such backflow can be definitely eliminated if the valve 235 is closed. Hence, the valve 235 is closed in step S821.

Subsequently, in the process of step S822, a message prompting the user to exchange the inktank 5 is displayed on the display unit of the operation panel 54. Then, in step S823, the CPU waits for the inktank 5 to be exchanged. When it is confirmed that the inktank 5 has been exchanged, the process advances to step S824, and the display of the message prompting the user to exchange the inktank 5 is turned off. Subsequently, the process returns to step S810, and the inktank residual detection is executed again.

Figure 5B:
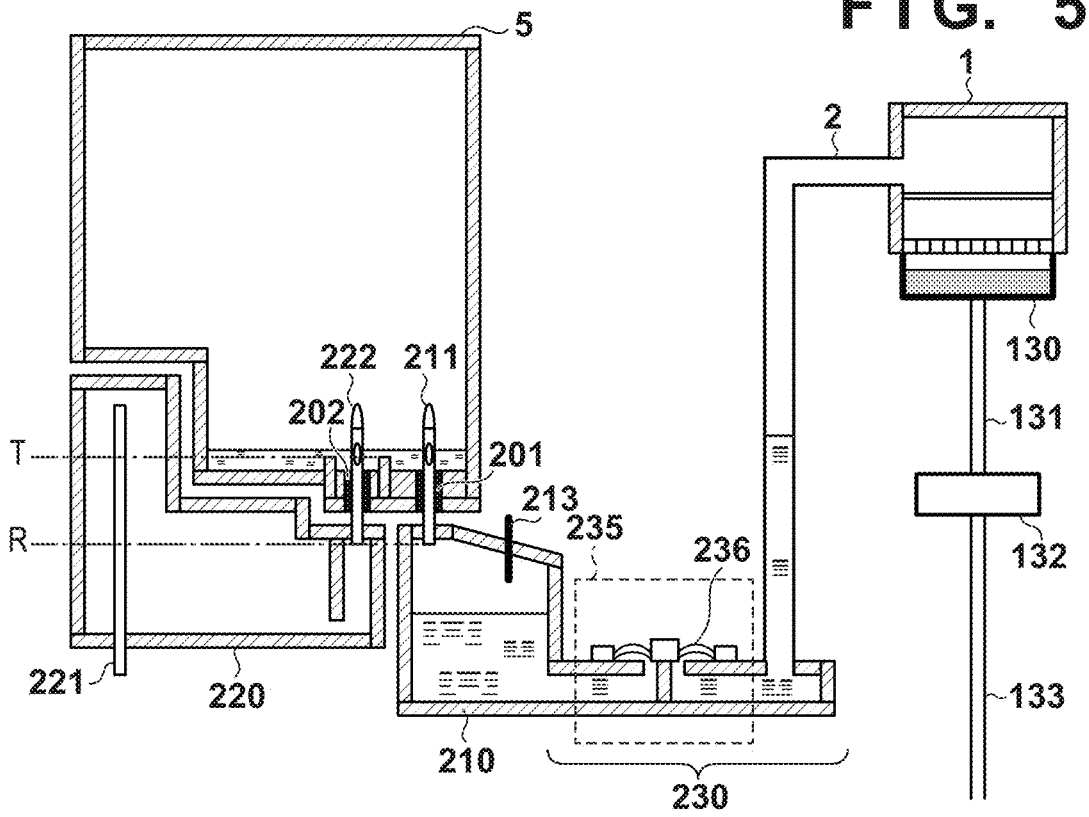

FIG. 5B shows the state of the ink supply subsystem in a case in which the inktank has been changed to the inktank 5 which contains a little more amount of ink than the small amount at the time of the inktank exchange.

If the result of the subtank residual detection is determined to be residual detection on (YES) in step S820, the process advances to step S840, and the above-described suction operation A sequence is executed again. Note that since the valve 235 is already open at this time, the process of step S801 in the suction operation A sequence described with reference to FIG. 8 will not be executed. In a case in which the valve 235 is already open in the same manner hereinafter, the process of step S801 in the suction operation A sequence will not be executed.

In consideration of that described above, in a case in which the result of the subtank residual detection is determined to be residual detection on (YES) in step S820 even if the result of the inktank residual detection is determined to be residual detection off (NO) in step S810, the suction operation A sequence will be executed in step S840. Hence, even in such a case, it is possible to prevent the problem of a small amount of ink remaining in the inktank to be exchanged.

Also, if the result of the inktank residual detection performed in step S810 is determined to be residual detection on (YES), the process advances to step S830, and it is determined whether the count value of the subtank counter is less than Sth. If it is determined that the count value of the subtank counter is less than Sth here, the process advances to step S840, and the suction operation A sequence is executed again. Note that since the value of Sth is larger than the value of the suction amount A, it will be determined in step S830 that the count value of the subtank counter is less than Sth (YES) in the state as shown in FIG. 5B. In contrast, if it is determined that the count value of the subtank counter is equal to or more than Sth (NO), the process advances to step S831, and the subtank filling sequence described above will be executed again. This is because bubbles will mix into the ink supply path 230 if the suction operation A sequence is executed without executing the subtank filling sequence when the count value of the subtank counter is equal to or more than Sth.

This reason will be described more specifically here.

A state in which the count value of the subtank counter is equal to or more than Sth represents that the amount of ink contained in the subtank 210 is small. If the suction operation A sequence is executed in a state in which the amount of ink contained in the subtank 210 is small, bubbles will mix into the ink supply path 230 even if there is a sufficient amount of ink contained in the inktank 5. This is because the evacuation elimination speed by the ink inflow from the inktank 5 cannot catch up with the evacuation speed in the subtank 210 by the suction operation A. The air in the subtank 210 which has expanded due to the execution of the suction operation A sequence will mix with the ink in the subtank 210 and enter the ink supply path 230.

From this reason, in a case in which the count value of the subtank counter is equal to or more than Sth, the subtank filling sequence will be executed, and the suction operation A sequence will be executed after the amount of ink in the subtank 210 has been increased to an "approximately filled-up amount". Note that, as described above, the count value of the subtank counter is reset to "0" after the execution of the subtank filling sequence.

Also, the valve 235 is opened from time to time albeit for a short time during the execution of the subtank filling sequence. If the valve 235 is opened, there is a possibility that the above-described "ink falling" will occur. That is, it is possible that the ink suction effect to the supply tube 2 obtained by the execution of the previous suction operation A sequence may be reduced. This is the reason why the suction operation A sequence is executed without the execution of the subtank filling sequence if it is determined in step S830 that the count value of the subtank counter is less than Sth.

Note that although the degree of "ink falling" at this time depends largely on the formation state of the menisci on the ink orifices of the printhead 1, in general at the time of the filling sequence after second transportation, this degree is not so large. At the time of the second transportation (transportation performed after the installation of the apparatus), the ink in the printing apparatus will be removed before the transportation, but it is difficult to completely remove the ink in the printhead 1 at this time. Also, whether the degree of "ink falling" at this time is of a degree that can influence the filling sequence after second transportation will be confirmed by a method which will be described later. If the degree of "ink falling" is confirmed to be a degree that has the influence, a coping operation will be performed in accordance with a method to be described later.

After the subtank filling sequence ends in step S831, the process advances to step S840, and the suction operation A sequence is executed again.

Figure 5C:
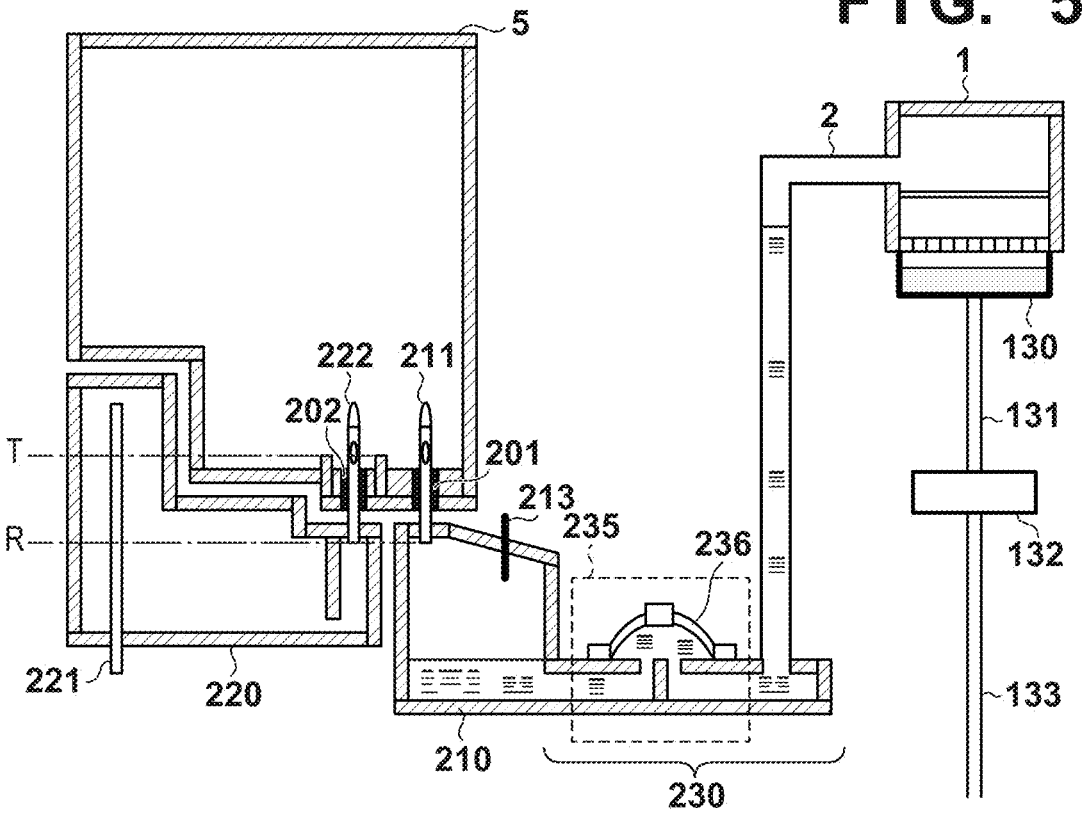

FIG. 5C shows the change in the state of the ink supply subsystem from the state shown in FIG. 5B after the execution of the suction operation A sequence.

Since there is only a little more amount of ink contained than a small amount in the inktank 5, the results of the inktank residual detection and the subtank residual detection both will be residual detection off at the end of the suction operation A. Thus, during the execution of the suction operation A sequence, the suction amount A obtained from the suction operation A will be added again to the subtank counter, and the total value will be double the suction amount A. Note that a value double the suction amount A is larger than the value of Sth.

After the end of the suction operation A sequence, the process advances to step S841, and the value of the counter M is incremented. Subsequently, the process advances to step S850, and whether the value of the counter M is equal to or more than 2, that is, whether the suction operation A sequence has been executed twice or more is determined. Here, if M<2, that is, if the suction operation A sequence in step S840 has been executed once, the process returns to step S810.

Note that since it is the state of inktank ink residual detection off and the subtank ink residual detection off when the process returns to step S810 in the state shown in FIG. 5C, the residual detection off (NO) will be determined in step S810, and the residual detection off (NO) will also be determined subsequently in step S820. Hence, a message prompting the user to exchange the inktank will be displayed in step S822, and when the inktank exchange is performed in response to the message, the process returns again to step S810.

Figure 5D:
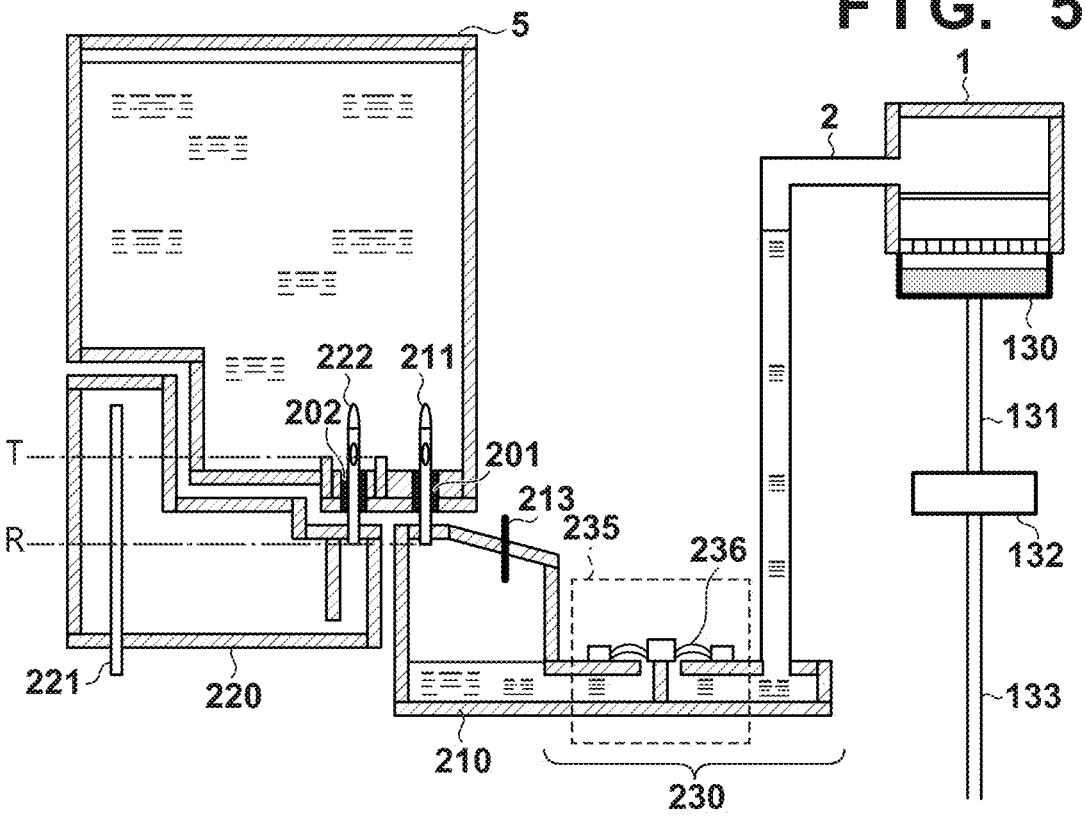

FIG. 5D shows the state of the ink supply subsystem in which the inktank has been changed to an inktank containing a sufficient amount of ink at the time of the inktank exchange.

After the inktank has been exchanged and the process returns to step S810 in the state shown in FIG. 5D, the residual detection on (YES) is obtained as the result when the inktank residual detection is executed. Subsequently, the process advances to step S830. Here, if the count value of the subtank counter is double the suction amount A and is larger than Sth, the count value of the subtank counter >Sth is determined, and the process advances to step S831. In step S831, the subtank filling sequence is executed again. Note that as described above, if the suction operation A is executed without executing the subtank filling sequence, bubbles will mix into the supply tube 2. Also, as described above, the count value of the subtank counter will be reset to "0" after the execution of the subtank filling sequence.

Figure 5E:
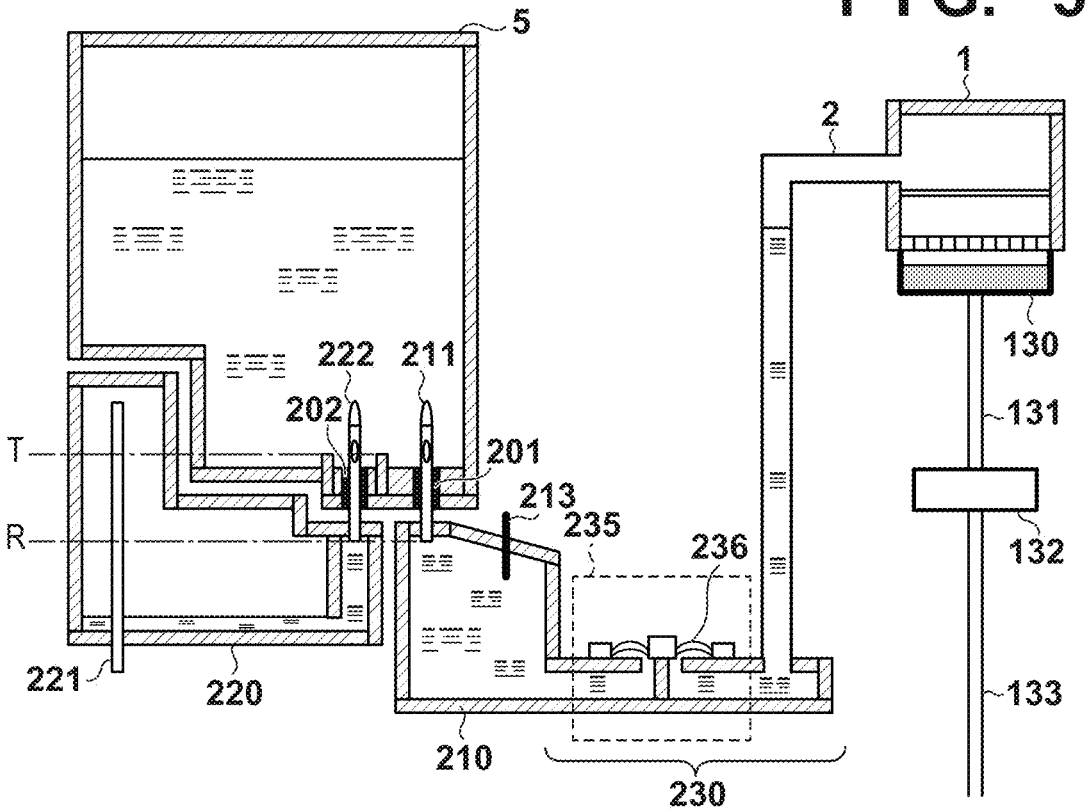

FIG. 5E shows the state of the ink supply subsystem after the subtank filling sequence has been executed from the state shown in FIG. 5D. As described above, since menisci will be formed on most of the ink orifices of the printhead 1 in many cases at the time of the filling after second transportation, the "ink falling" described above hardly occurs.

Subsequently, in step S840, the suction operation A sequence is executed for the third time, and the value of the counter M is incremented in step S841. Subsequently, in step S850, since the value of the counter M is 2, the determination is affirmative (YES), and the process advances to step S851.

Figure 5F:
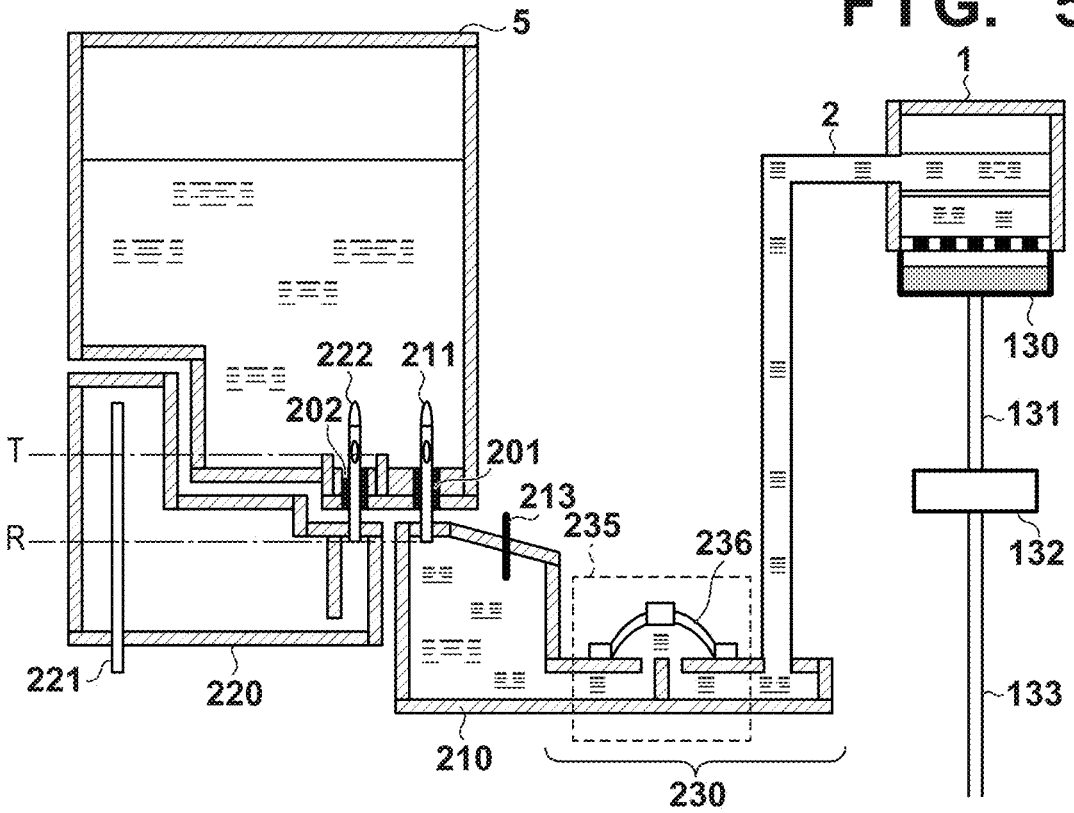
Figure 6A:
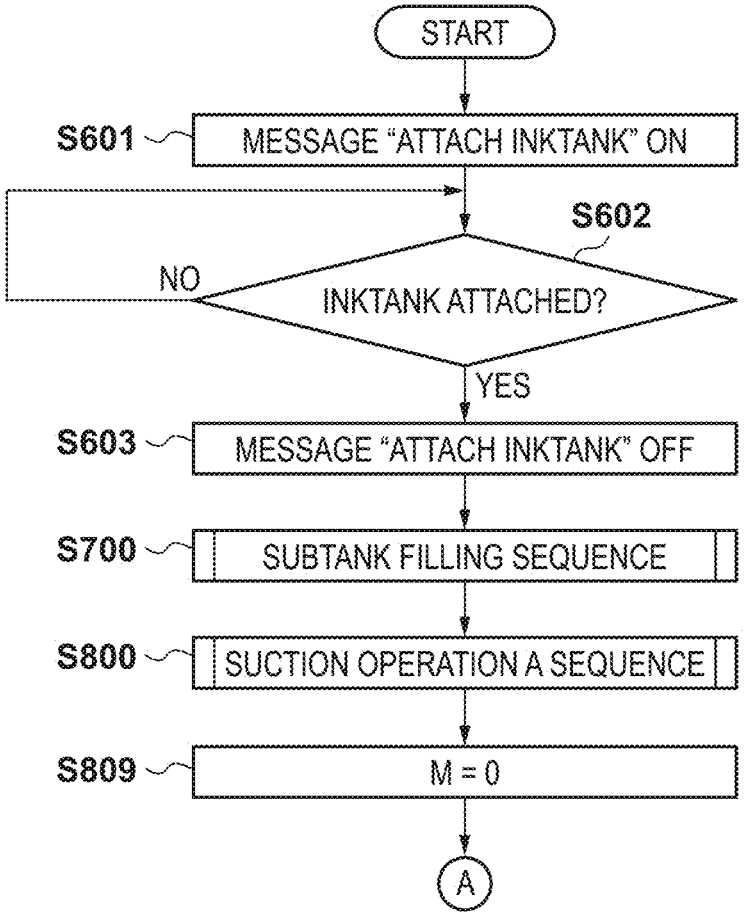
FIGS. 6A, 6B, and 6C are flowcharts showing the overall filling sequence after second transportation according to the first embodiment.
Figure 6B:
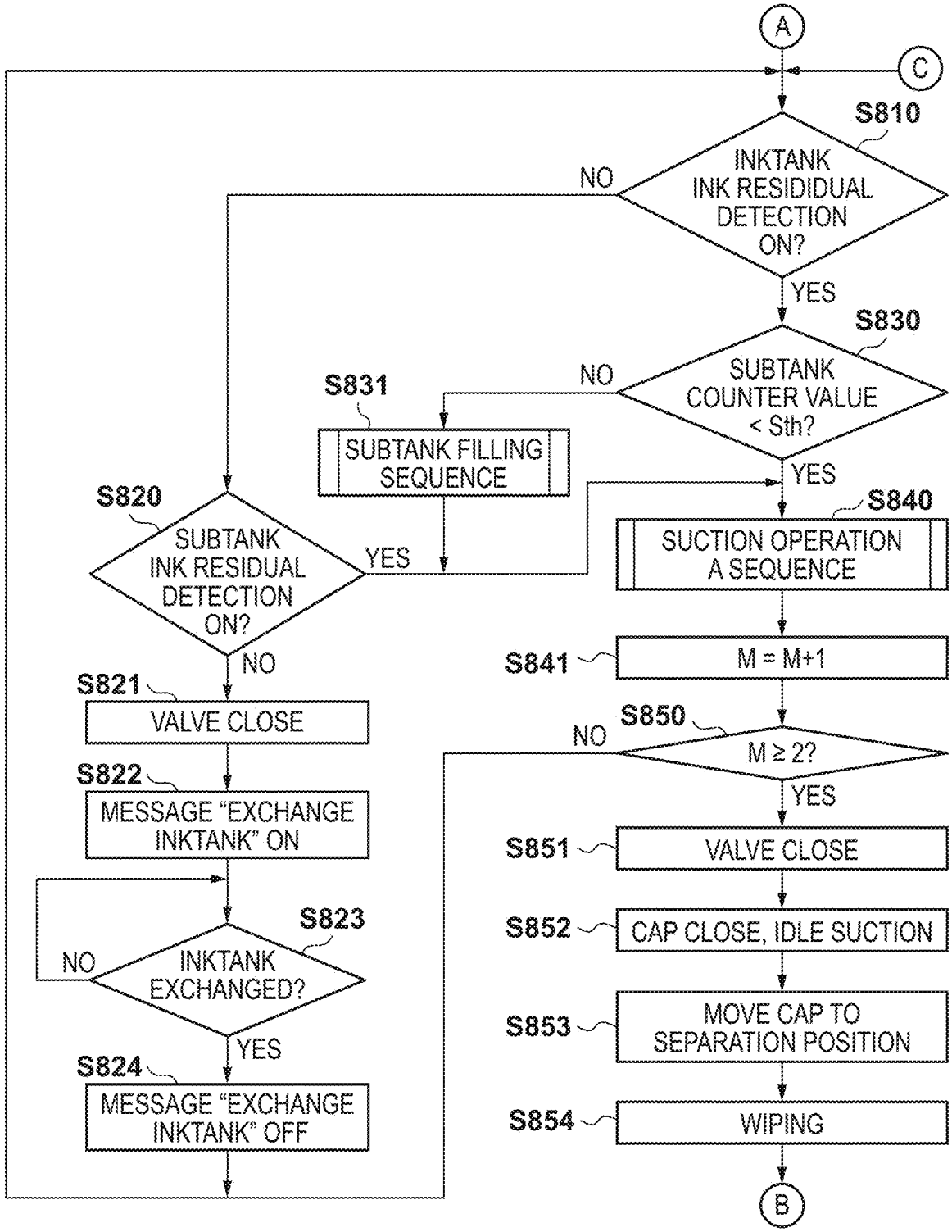
Figure 6C:
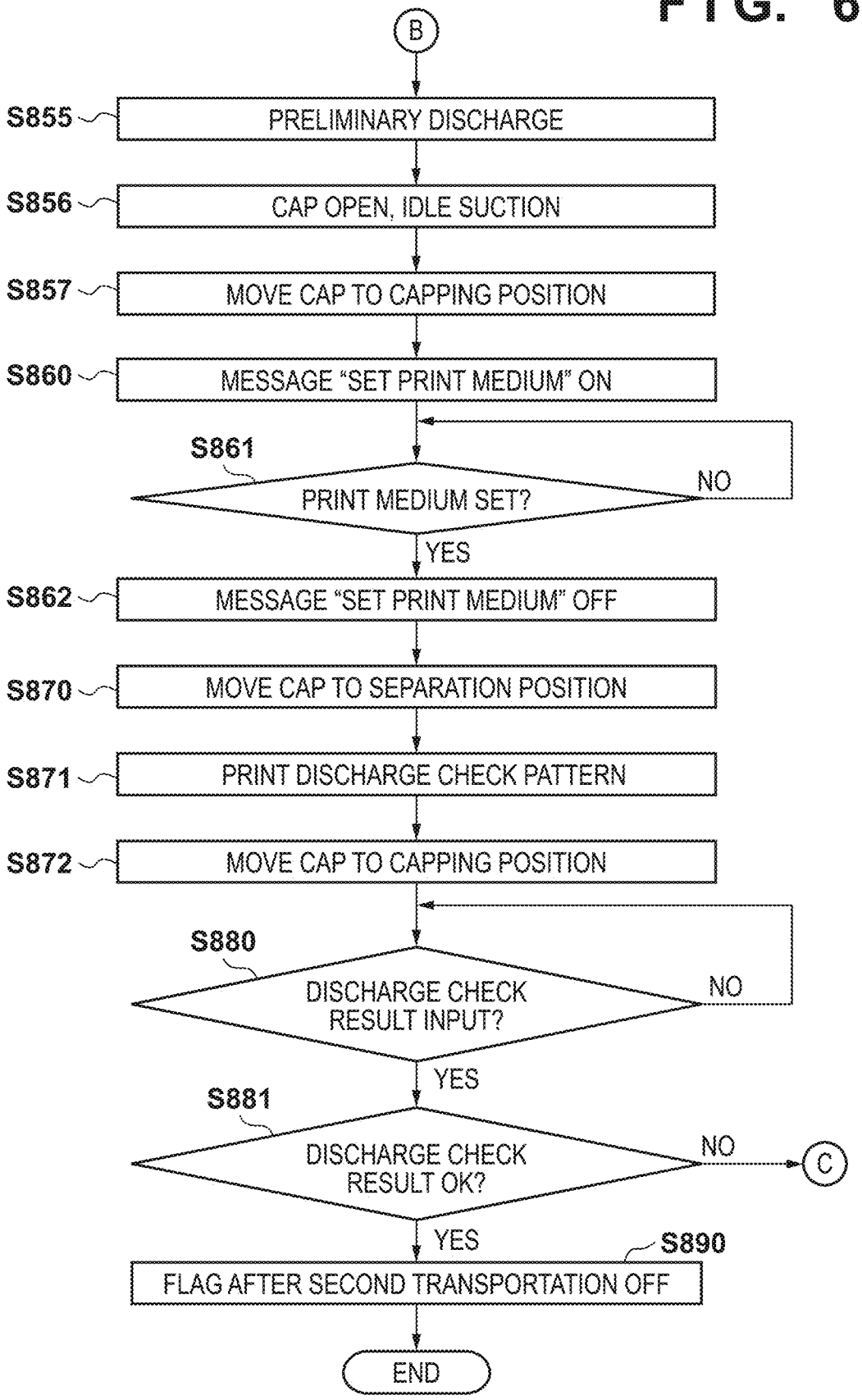
Figure 7:
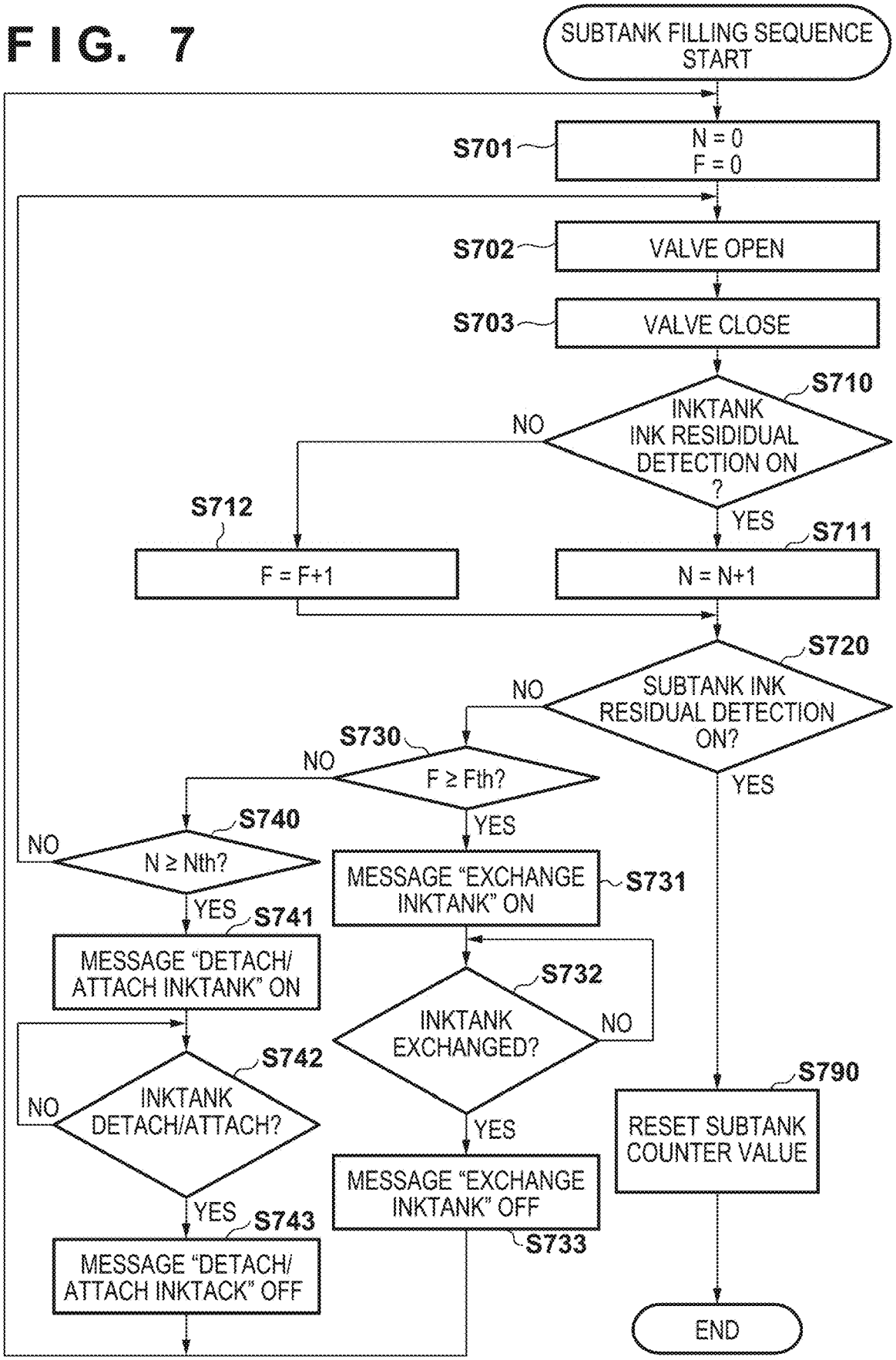
FIG. 7 is a flowchart showing the details of a subtank filling sequence according to the first embodiment.
Figure 8:
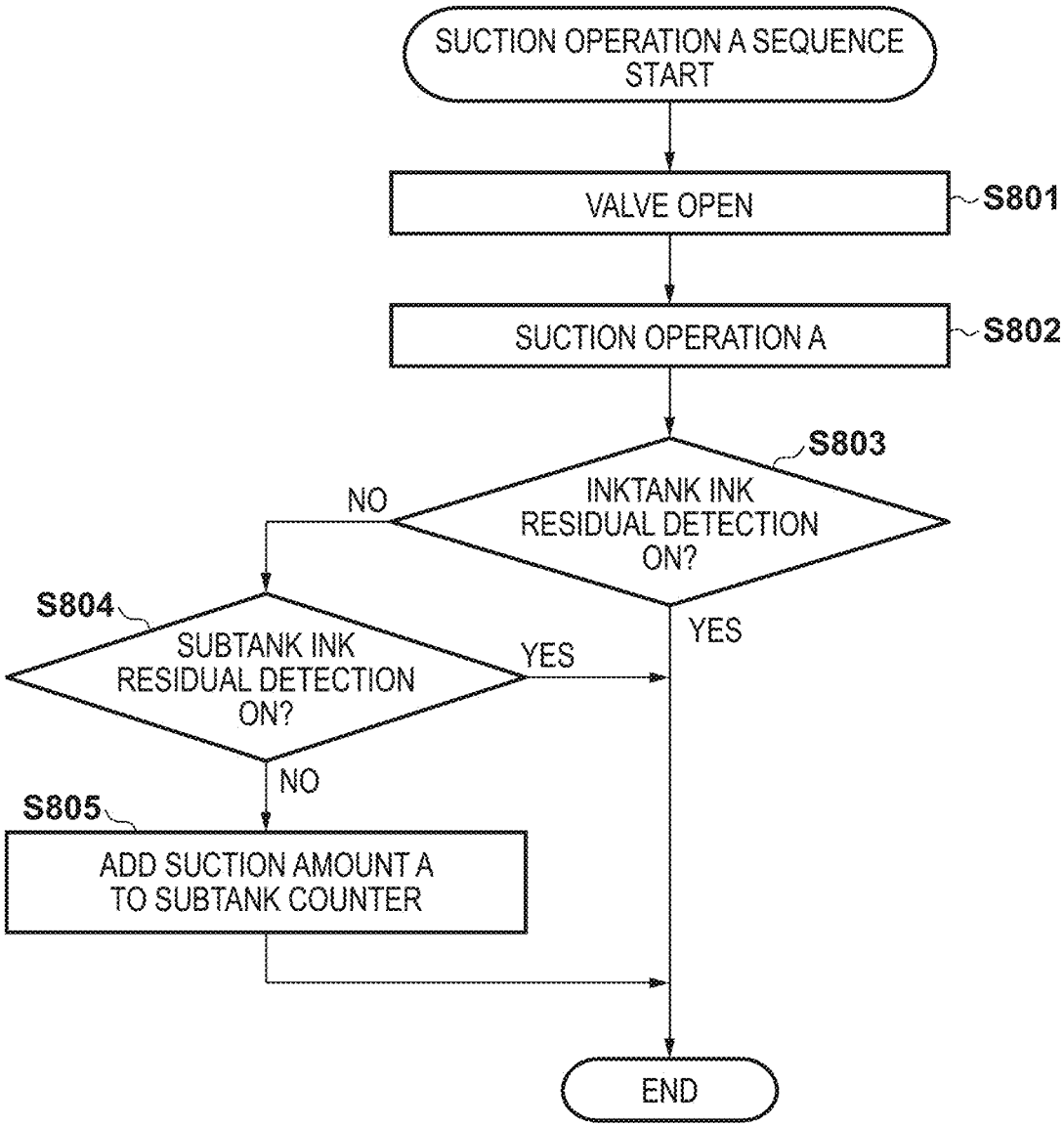
FIG. 8 is a flowchart showing the details of a suction operation A sequence according to the first embodiment.

FIG. 5F shows the state of the ink supply subsystem after the suction operation A sequence has been executed from the state shown in FIG. 5E. As shown in FIG. 5F, by executing the suction operation A sequence once in step S800 and the suction operation A sequence twice in step S840, that is, by executing the suction operation A sequence three times in total, the ink in the subtank 210 has reached the printhead 1.

The valve 235 is closed in step S851. This is to eliminate the risk of the "ink falling" described above. If the above-described "ink falling" has occurred in the subtank filling sequence performed in step S831, there is a possibility that the printhead 1 has not been filled with ink even after the suction operation A sequence has been executed three times in the above described manner. If the printhead 1 has not been filled with ink, there is a possibility that the menisci are not formed on the ink orifices of the printhead 1. The "ink falling" may occur if the menisci are not formed on the ink orifices of the printhead 1. The valve 235 is closed in step S851 to eliminate this risk.

Subsequently, the process advances to step S852, and a cap close/idle suction operation is executed. More specifically, the driving of the suction pump 132 is started almost simultaneously with the opening of an outer air valve (not shown) included in the cap 130, and this driving operation is continued for five seconds. The ink in the cap 130 is discharged to the maintenance cartridge (not shown) via a pump tube 131 and a waste ink tube 133 by this cap close/idle suction operation.

In addition, in the process of step S853, the cap 130 is moved to a separation position. Subsequently, in step S854, a known wiping mechanism (not shown) wipes an ink orifice surface 102 of the printhead 1 and removes foreign substances such as unnecessary ink, dust, and the like on the ink orifice surface 102. Subsequently, in step S855, a known preliminary discharge operation is executed.

More specifically, ink droplets are discharged approximately five hundred times into the cap 130 from all of the ink orifices of the printhead 1. This preliminary discharge operation is performed to improve the ink discharge performance of the printhead 1. Since the valve 235 is closed at this time, ink corresponding to the amount of ink lost from the printhead 1 due to this preliminary discharge operation will not be supplied from the subtank 210. Hence, the absolute value of the negative pressure inside the printhead 1 will rise in correspondence to this amount.

Subsequently, the process advances to step S856, and the cap open/idle suction operation is executed by driving the suction pump 132 while keeping the cap 130 positioned in the separation position. The ink that was discharged to the cap 130 by the preliminary discharge operation is discharged to the maintenance cartridge (not shown) via the pump tube 131 and the waste ink tube 133 by the cap open/idle suction operation. Furthermore, in step S857, the cap 130 is moved to the capping position.

Subsequently, in step S860, a message to prompt the user to set a print medium on the printing apparatus is displayed on the display unit of the operation panel 54. Subsequently, in step S861, the CPU waits for the print medium to be set on the printing apparatus. Here, if it is confirmed that the print medium has been set, the process advances to step S862, and the display of the message to prompt the user to set the print medium is turned off. Note that a known photointerrupter (not shown) or the like is used to confirm the setting of the print medium.

Subsequently, in step S870, after the cap 130 has been moved to the separation position, a known discharge check pattern printing operation is performed in step S871. Since the valve 235 is closed also at this time, ink corresponding to the amount of ink lost from the printhead 1 due to this discharge check pattern printing operation will not be supplied from the subtank 210. Hence, the absolute value of the negative pressure inside the printhead 1 will further rise in correspondence to this amount. After the end of the printing operation, the cap 130 is moved to the capping position in step S872.

Subsequently, in step S880, the CPU waits for the user to visually check the printed discharge check pattern and input the result. At this time as well, the user uses the operation panel 54 and presses an "OK key" if the discharge is OK or presses an "NG key" if the discharge is not OK as a result of the visual check.

After the input of the visual check result of the discharge check pattern has been completed, the process advances to step S881, and it is checked whether the input result is "OK" or "NG". In this case, if the input result is "NG", the process returns to step S810, and the discharge check pattern is printed again after executing the suction operation A sequence in step S840 and other processes once more. Subsequently, the CPU waits for the user to input the visual check result of the discharge check pattern. In contrast, if the input result is "OK", the process advances to step S890, and the filling sequence after second transportation will end after setting the after second transportation flag to OFF.

As described above, in the filling sequence after second transportation, the suction operation A sequence and the other processes are executed until the user confirms that the discharge is "OK", that is, until the user confirms that the printhead 1 has been filled with ink. Note that the after second transportation flag is set to ON after the ink is removed from the printing apparatus before the transportation of the printing apparatus.

Hence, according to the embodiment described above, in the filling sequence after second transportation, the suction operation for filling the ink supply path with ink can be executed if there is a sufficient amount of ink in the subtank even when there is no ink in the inktank. As a result, this can minimize the occurrence of a case in which a small amount of ink will remain in the inktank to be exchanged. In contrast, when a sufficient amount of ink is not present in the subtank, the suction operation for filling the ink supply path with ink is executed after making the amount of ink in the subtank sufficient again by executing the subtank filling sequence. The mixing of bubbles into the ink supply path can be prevented in this manner.

Second Embodiment

An initial filling sequence in an ink supply subsystem of a printing apparatus that includes an arrangement as that described above will be described next with reference to the drawings. Note that the initial filling sequence is started when it is detected that an inktank 5 has been initially attached to the printing apparatus. In this manner, the initial filling sequence is a filling sequence performed when initially supplying ink from the inktank to components such as a subtank, a supply tube, a printhead, and the like that have not been supplied with ink yet, and filling these components with ink.

Figure 9:
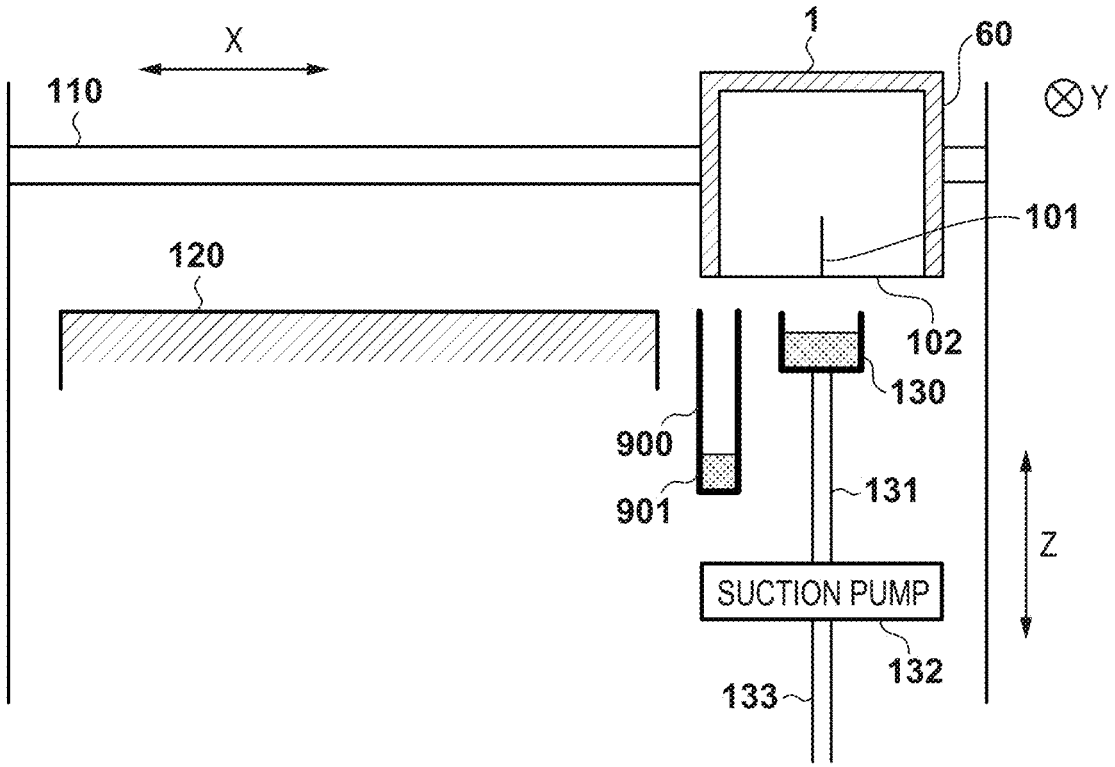
FIG. 9 is a section view schematically showing some components arranged along a path on which a printhead of the printing apparatus shown in FIG. 1 is to move.

First, FIG. 9 is a sectional view schematically showing some components provided along a path on which the printhead of the printing apparatus that was shown in FIG. 1 moves. In FIG. 9, a carriage 60 on which a printhead 1 is mounted reciprocally moves on a platen 120 along a guide shaft 110 in an arrow X direction. In addition, as shown in FIG. 9, a detection unit 900 for detecting ink droplets that are discharged from the printhead 1 is arranged near a home position of the carriage.

The detection unit 900 itself is a known photointerruptive unit and includes, internally, a light emitting element (not shown) and a light receiving element (not shown) for receiving the light from the light emitting element in a direction (Y direction) perpendicular to the paper surface shown in FIG. 9. In addition, an ink absorbing member 901 has been provided at the inner bottom of the detection unit 900. The presence/absence of ink droplet discharge is detected by causing ink droplets to be discharged from the ink orifices of the printhead 1 to the ink absorbing member 901 of the detection unit 900 and detecting the changes in the light amount received by the light receiving element at that time.

Note that since other components have been described with reference to FIG. 2, the same reference numerals are used to denote these components, and a description thereof will be omitted. In addition, the detection unit 900 is also controlled by a sensor controller 370 in the same manner as various sensors 375.

An initial filling sequence that is executed in a printing apparatus arranged in this manner will be described hereinafter with reference to views showing the states of an ink supply subsystem shown in FIGS. 10A to 11D and the flowcharts shown in FIGS. 12A to 15.

Assume that an initial flag is set to ON when the printing apparatus is powered on in the initial filling sequence. Note that the initial flag is set to ON before the printing apparatus is shipped.

First, in step S1201, a message to prompt a user to attach a printhead to the printing apparatus is displayed on a display unit of an operation panel 54 to the user. Subsequently, in step S1202, the CPU waits for the printhead to be attached to the printing apparatus, the process advances to step S1203 when the attachment is confirmed, and the display of the message to prompt the user to attach the printhead is set to OFF. Note that an electrical connection detection arrangement is used to confirm the attachment of the printhead in the same manner as the arrangement used to confirm the inktank connection described in the first embodiment.

Subsequently, the process advances to step S1204, and a message to prompt the user to attach an inktank to the printing apparatus is displayed on the display unit of the operation panel 54 to the user. Subsequently, in step S1205, the CPU waits for the inktank to be attached to the printing apparatus, the process advances to step S1206 when the attachment is confirmed, and the display of the message to prompt the user to attach the inktank is set to OFF. Note that the confirmation of the inktank attachment is the same as that described in the first embodiment.

Figure 10A:
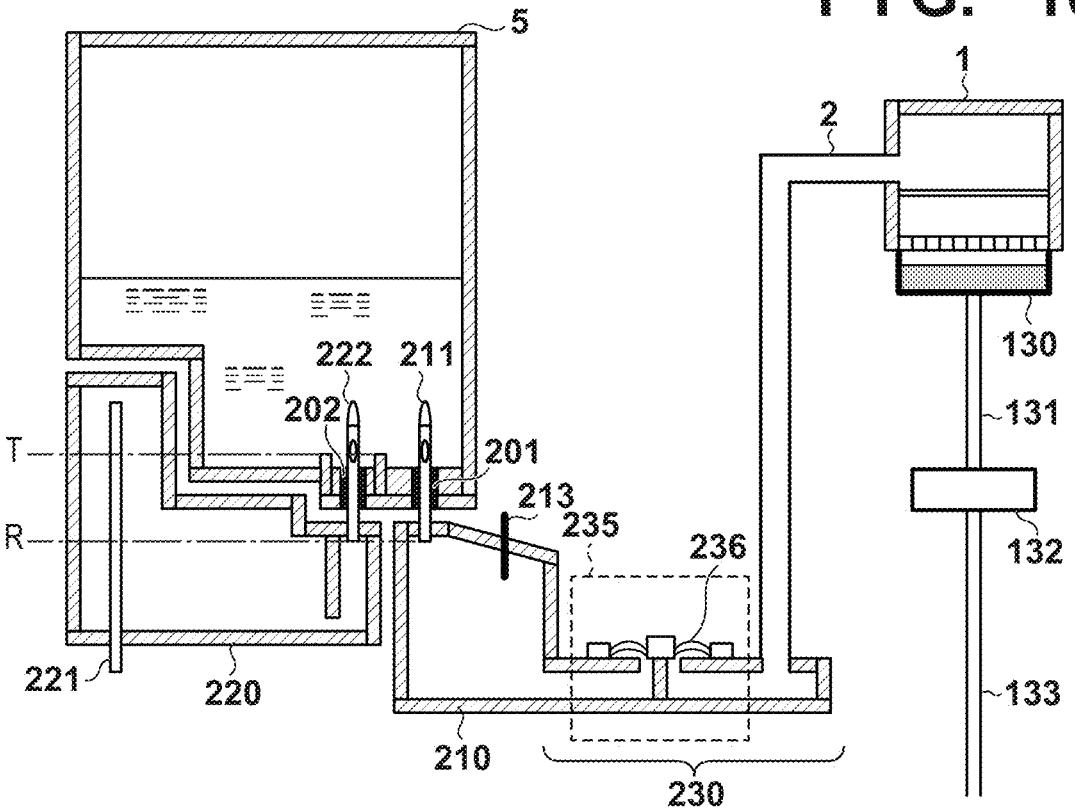
FIGS. 10A, 10B, 10C, 10D, 10E, and 10F are views showing the changes in the state of an ink supply subsystem corresponding to an initial filling sequence according to the second embodiment.

FIG. 10A is a view showing the state of the ink supply subsystem when a not new (used) inktank 5 is attached to the printing apparatus. At this time, in the same manner as the first embodiment, a cap 130 is positioned in a capping position, and a valve 235 is closed. Also, in the same manner as the first embodiment, since a gas-liquid exchange does not occur within a first hollow tube 211 and a second hollow tube 222, the ink in the inktank 5 will not flow out into a buffer room 220 and a subtank 210 just by attaching the inktank 5 to the printing apparatus. This will not be the case, however, if there is a difference between the internal pressure of the inktank 5 and the outer air pressure of the installation environment of the printing apparatus.

Subsequently, the process advances to step S1210, and an inktank residual detection as described above is executed. If the result is determined to be residual detection off (NO) here, the process advances to step S1300, and an inktank exchange sequence will be executed.

Figure 13:
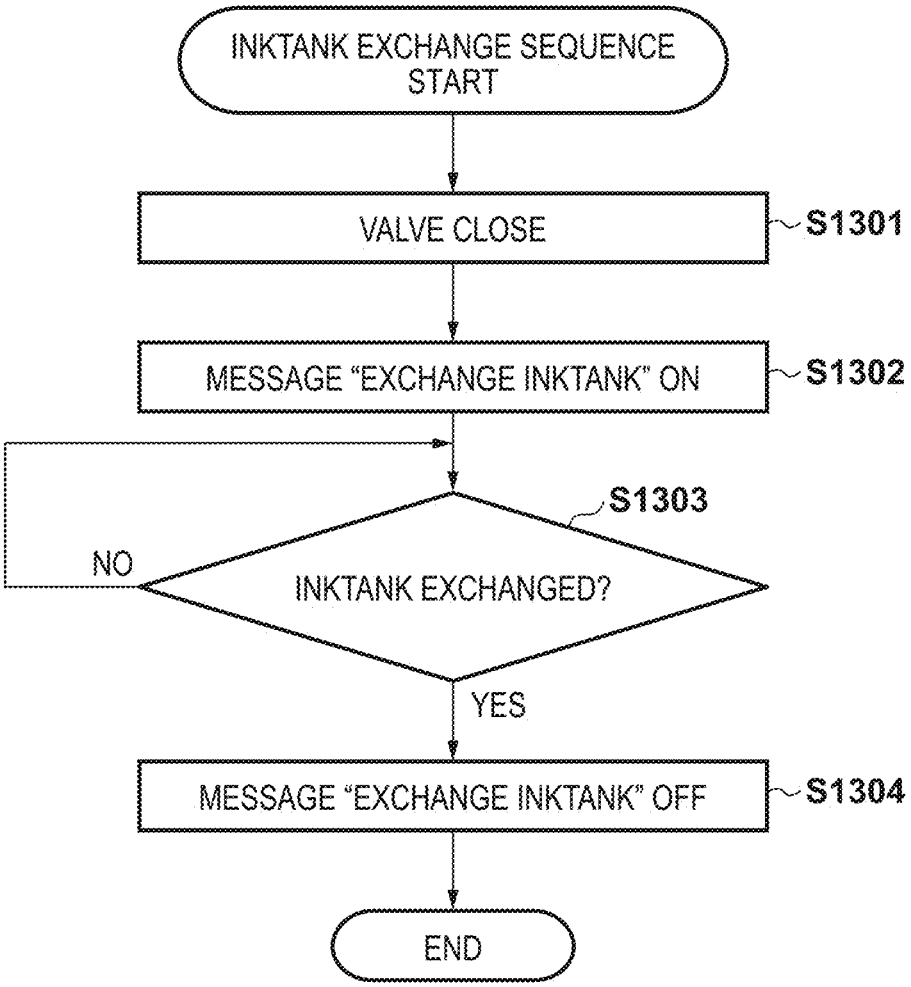
FIG. 13 is a flowchart showing an inktank exchange sequence according to the second embodiment.

FIG. 13 is a flowchart for explaining the inktank exchange sequence. The inktank exchange sequence will be described here with reference to FIG. 13.

When the inktank exchange sequence is started, the valve 235 is closed in step S1301. Note that since the valve 235 is already closed at this time, nothing is executed in step S1301. The same applies to subsequence processes, and in a case in which the valve 235 is already closed, nothing will be executed in step S1301. The purpose of closing the valve 235 is to eliminate the risk of "ink falling" as described above, but no "ink falling" has occurred at this time.

Next, in step S1302, a message to prompt the user to exchange the inktank is displayed on the display unit of the operation panel 54 to the user. Subsequently, the process advances to step S1303, and the CPU waits for the inktank to be exchanged. The process advances to step S1304 when the attachment is confirmed, and the inktank exchange sequence ends after the display of the message to prompt the user to exchange the inktank 5 is set to OFF. After the end of the inktank exchange sequence, the process returns to step S1210, and the inktank residual detection is executed again.

In contrast, if the result of the inktank residual detection in step S1210 is determined to be residual detection on (YES), the process advances to step S1310. That is, if it is determined to be inktank ink residual detection on, more specifically, if the inktank 5 containing ink whose liquid surface position is higher than a position indicated by T in FIGS. 10A to 10F is attached to the printing apparatus, the process advances to step S1310. Note that the result of the inktank residual detection in step S1210 will be residual detection on (YES) in a case as shown in FIG. 10A.

In step S1310, a suction operation B is executed. More specifically, a suction pump 132 is driven for thirty seconds. At this time, since the valve 235 is closed, the suction operation B evacuates the printhead 1 and a portion on a downstream side of the valve in an ink supply path 230. Subsequently, the process advances to step S1311, and the valve 235 is opened. When the valve 235 is opened, the air from the subtank 210 flows to the downstream side of the valve in the ink supply path 230 to eliminate the evacuation of the printhead 1 and a portion on a downstream side of the valve in an ink supply path 230. Then, an amount of ink corresponding to the air flows from the inktank 5 into the subtank 210 via the first hollow tube 211. Then, an amount of air corresponding to the amount of the ink flows from the buffer room 220 into the inktank 5 via the second hollow tube 222. Subsequently, an amount of air corresponding to the amount of this air (outer air) flows into the buffer room 220 via an air communication path 221. The evacuation described above is eliminated by the generation of the ink and air flow in this manner.

Subsequently, in step S1312, the CPU waits for five seconds for the evacuation of the printhead 1 and a portion on a downstream side of the valve in an ink supply path 230 to be eliminated. During the five-second wait, the flow of ink and air is generated as described above, and the above-described evacuation is eliminated.

A suction operation formed by a series of operations in which the valve 235 is closed, the suction operation B is executed, the valve 235 is opened, and the CPU waits for five seconds will be referred to as a choke suction B.

Figure 10B:
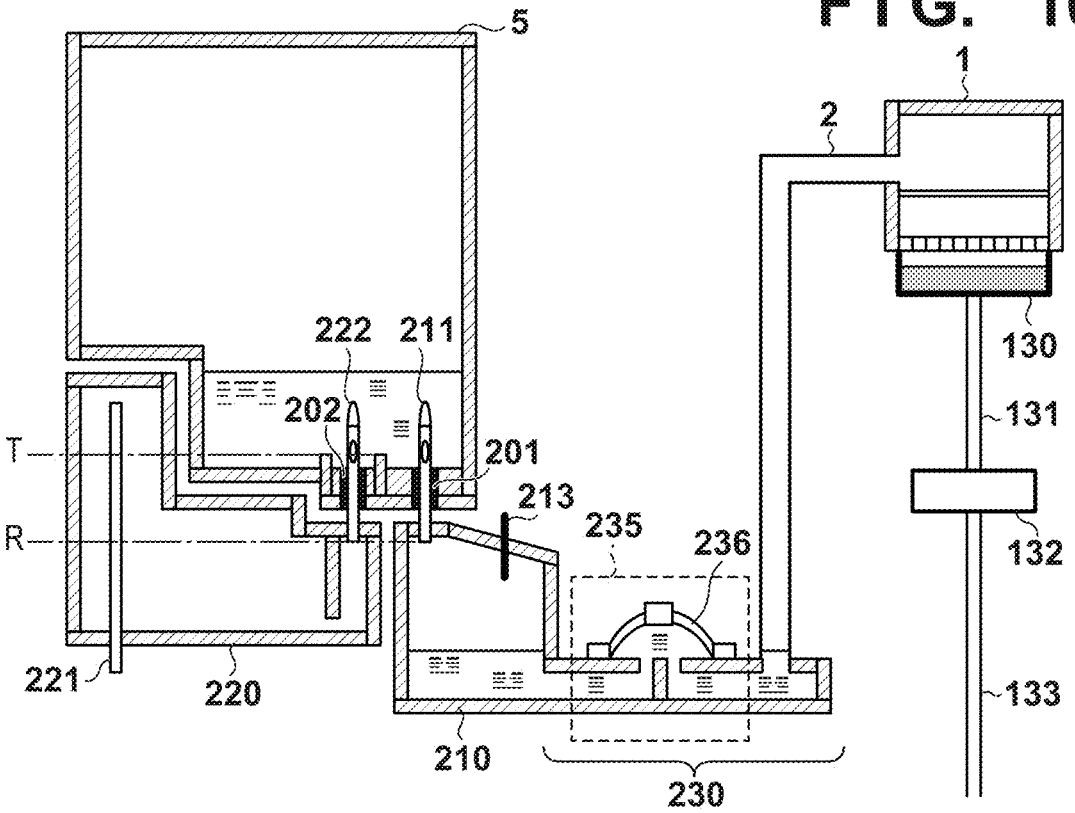

FIG. 10B shows the state of the ink supply subsystem after the choke suction B has been executed from the state shown in FIG. 10A. The ink in the inktank 5 has been sucked out to a portion including the opening and closing unit of the valve 235 of the ink supply path 230 and the bottom of the subtank 210. Note that, as described, if a choke suction, for example, the choke suction B is performed one more time in this state, ink that has mixed with the air in the subtank 210 will enter into a portion on the downstream side of the valve in the ink supply path 230. In other words, a large amount of bubbles will mix into the ink in a portion on the downstream side of the valve in the ink supply path 230.

Subsequently, in step S1313, the subtank filling sequence described above is executed. Since the subtank filling sequence has been described with reference to FIG. 7 in the first embodiment, a description will be omitted.

Note that the state of the execution of the subtank filling sequence in step S1313 differs a little from the state of the execution of the subtank filling sequence in step S700.

At the execution of the subtank filling sequence in step S700, the subtank filling operation is started from a state in which there is no ink contained in the subtank 210. In contrast, at the execution of the subtank filling sequence in step S1313, the subtank filling operation is started from a state in which the bottom of the subtank 210 and the like have already been filled with ink. Hence, the time required to complete the subtank filling sequence is much shorter at the execution of the subtank filling sequence in step S1313 than at the execution of the subtank filling sequence in step S700. This is because the amount of ink that is to be moved into the subtank 210 is small and the state of the subtank filling efficiency is also high as described above.

Note that it is desirable to employ a choke suction method such as the choke suction B to perform a suction operation for such subtank filling supplementation. This is because the choke suction method can move more amount of ink to the subtank 210 while preventing the mixing of bubbles into a supply tube 2 than the suction method in which the suction pump 132 is driven while keeping the valve 235 open which was described in the first embodiment.

Figure 10C:
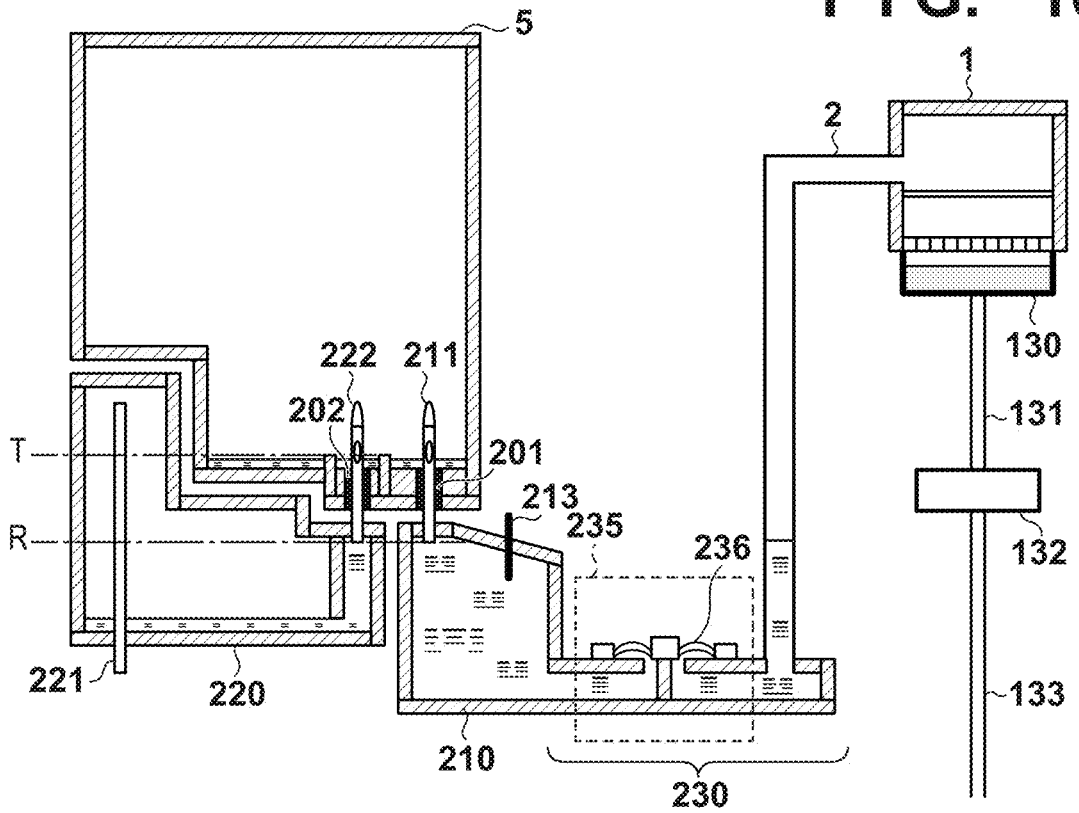

FIG. 10C shows the state of the ink supply subsystem after the subtank filling sequence has been executed from the state shown in FIG. 10B. Since the subtank filling operation is performed until the end of the subtank filling sequence, that is, until the result of the subtank residual detection becomes residual detection on, the ink amount of the subtank 210 becomes the "approximately filled-up amount". At this time, the amount of ink in the inktank 5 is equal to or less than a small amount, more specifically, the liquid surface position of the ink in the inktank 5 is lower than the position indicated by T in FIGS. 10A to 10F.

Upon completion of the execution of the subtank filling sequence, a suction operation C sequence is executed in step S1400.

Figure 14:
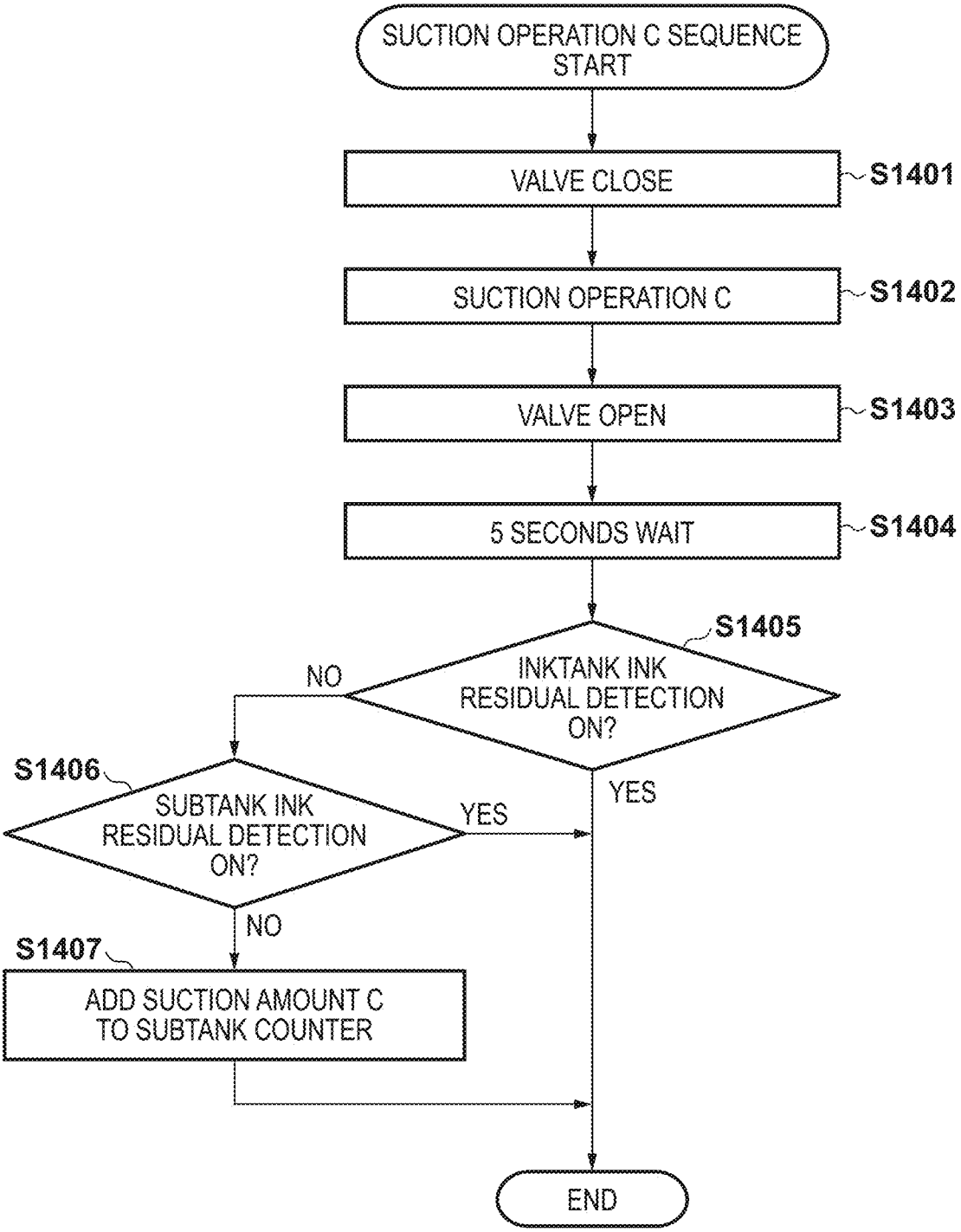
FIG. 14 is a flowchart showing a suction operation C sequence according to the second embodiment.

The suction operation C sequence will be described with reference to FIGS. 10A to 10F and the flowchart shown in FIG. 14.

When the suction operation C sequence is started, the valve 235 is closed in step S1401. Note that since the valve 235 is already closed at this time, nothing is executed in step S1401. Subsequently, in step S1402, a suction operation C is executed. More specifically, the suction pump 132 is driven for twenty seconds. The suction operation C evacuates the printhead 1 and the portion on the downstream side of the valve in the ink supply path 230.

Subsequently, in step S1403, the valve 235 is opened, and the CPU waits for five seconds in step S1404 for the evacuation of the printhead 1 and the portion on the downstream side of the valve in the ink supply path 230 to be eliminated by the flow of the ink and air as described above.

An operation formed by the processes of steps S1401 to step S1404 will be referred to as a choke suction C hereinafter.

Figure 10D:
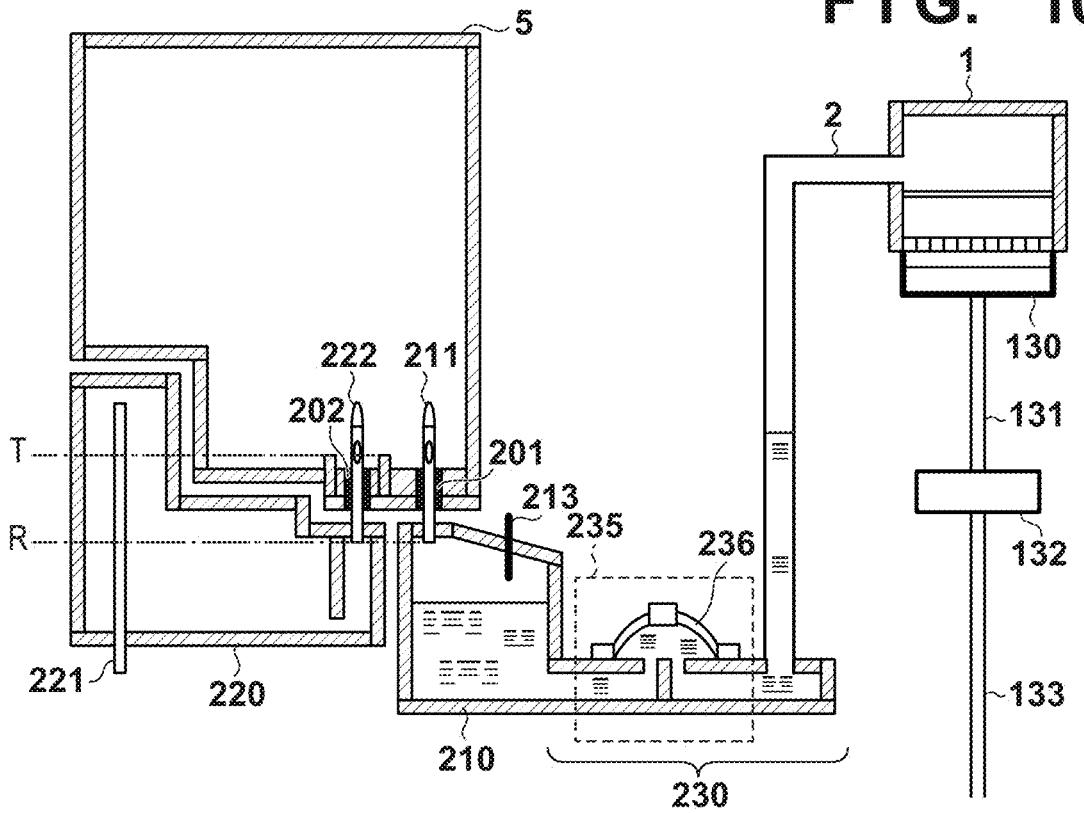

FIG. 10D shows the state of the ink supply subsystem after the choke suction C has been executed from the state shown in FIG. 10C. The choke suction C causes the amount of ink remaining in the inktank 5 to be approximately zero, and the amount of ink contained in the subtank 210 will be less than the "approximately filled-up amount".

Since a sufficient amount of ink is contained in the subtank 210 also at this time, it prevents bubbles from mixing into the supply tube 2. In addition, since the choke suction C is executed regardless of the result of the inktank residual detection even if the result is residual detection off, it can prevent a small amount of ink from remaining problematically in the inktank to be exchanged.

Subsequently, the process advances to step S1405, the inktank residual detection is executed, and the result is determined. If it is determined that the result is residual detection off (NO) here, the process advances to step S1406. Note that the result of the inktank residual detection will be the residual detection off since the amount of ink remaining in the inktank 5 is approximately zero in an example as shown in FIG. 10D.

In step S1406, the subtank residual detection is executed, and the result is determined. If the result is determined to be the residual detection off (NO) here, the process advances to step S1407. Note that in an example as shown in FIG. 10D, since the amount of ink in the subtank 210 is less than the "approximately filled-up amount", the result of the subtank residual detection will be the residual detection off. In step S1407, a suction amount C obtained from the choke suction C is added to a subtank counter. Subsequently, the suction operation C sequence ends. In contrast, if the result of the subtank residual detection in step S1406 is determined to be the residual detection on (YES), the suction operation C sequence will end as it is.

Also, in a case in which the result of the inktank residual detection in step S1405 is determined to be the residual detection on, the suction operation C sequence will end as it is.

Hence, if it is determined to be in the state of the inktank ink residual detection off and the subtank ink residual detection off after the end of the choke suction C, the suction amount C obtained from the choke suction C is added to the subtank counter. Otherwise, the suction operation C sequence will end just as it is.

The description will continue by referring back to FIGS. 12A and 12B. Upon completion of the execution of the suction operation C sequence in step S1400, the process advances to step S1409, and the value of a counter L is reset to "0". The counter L is a counter for counting the number of the times the suction operation C sequence, which is to be subsequently executed, has been executed.

Subsequently, in the process of step S1410, the inktank residual detection is executed again, and its result is determined. If the result is determined to be the residual detection off (NO) here, the process advances to step S1420. In step S1420, the subtank residual detection is executed, and its result is determined. If the result is determined to be the residual detection off (NO) here, the process advances to step S1421, and the above-described inktank exchange sequence is executed.

Note that in an example shown in FIG. 10D, since the state of the inktank ink residual detection off and the subtank ink residual detection off is determined, the inktank is exchanged.

Figure 10E:
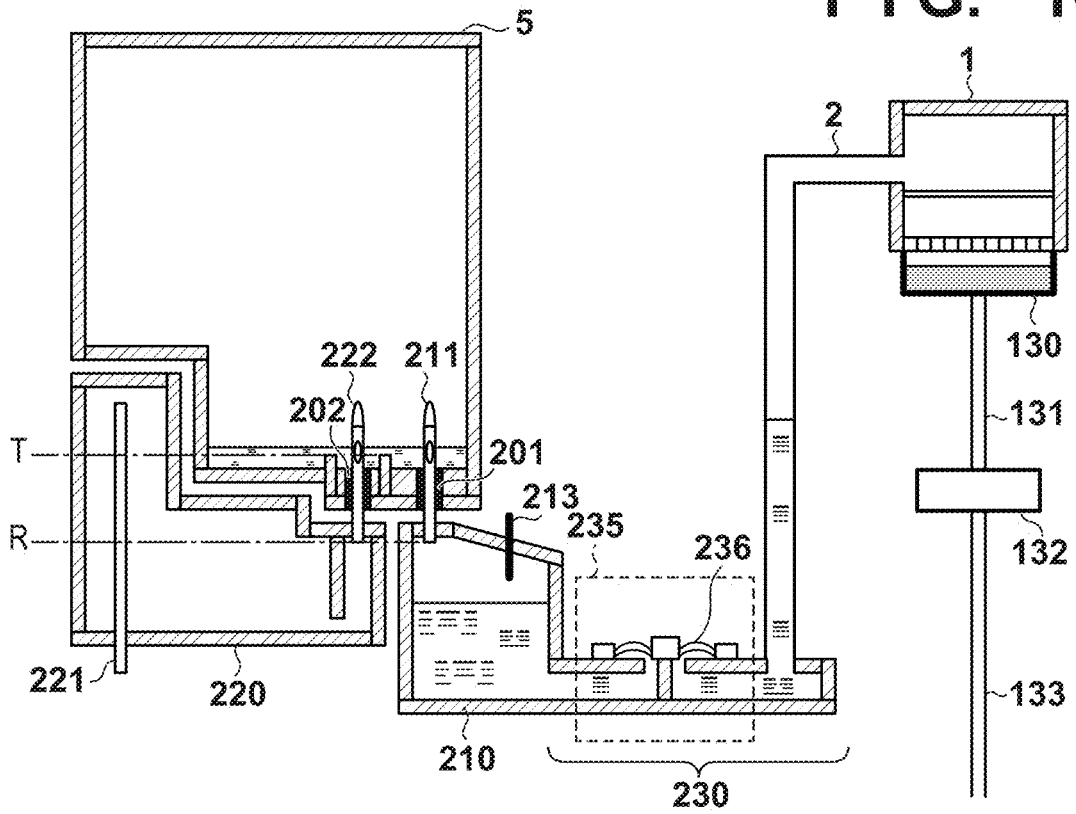

FIG. 10E shows the state of the ink supply subsystem when the inktank is exchanged with an inktank containing ink whose liquid surface position is higher than a position indicated by T shown in FIGS. 10A to 10F at the time of the inktank exchange.

After the end of the inktank exchange sequence, the process returns to step S1410, and the inktank residual detection is executed again.

In a case in which the result of the subtank residual detection in step S1420 is determined to be residual detection on (YES), the process advances to step S1440, and the suction operation C sequence described above will be executed again. That is, even if the result of the inktank residual detection is residual detection off, if the result of the subtank residual detection is determined to be residual detection on, the process advances to step S1440 and the suction operation C sequence will be executed. Hence, at this time, it is possible to prevent the problem of a small amount of ink remaining in the inktank to be exchanged as that described above.

In addition, in a case in which the result of the inktank residual detection in step S1410 is residual detection on, the process advances to step S1430, and it is determined whether the count value of the subtank counter is less than SSth. If it is determined that the count value of the subtank counter is less than SSth here, the process advances to step S1440, and the suction operation C sequence is executed again. Note that since the value of SSth is larger than the value of the suction amount C, it will be determined that the count value of the subtank counter is less than SSth in the state as shown in FIG. 10E.

In contrast, if it is determined that the count value of the subtank counter is equal to or more than SSth, the process advances to step S1431, and the subtank filling sequence described above will be executed again. This is because bubbles will mix into the ink supply path 230 if the suction operation C sequence is executed without executing the subtank filling sequence when the count value of the subtank counter is equal to or more than SSth. Note that there is a possibility of "ink falling" occurring during the execution of the subtank filling sequence at this time. After the process of step S1431 ends, the process advances to step S1440, and the suction operation C sequence is executed again.

Figure 10F:
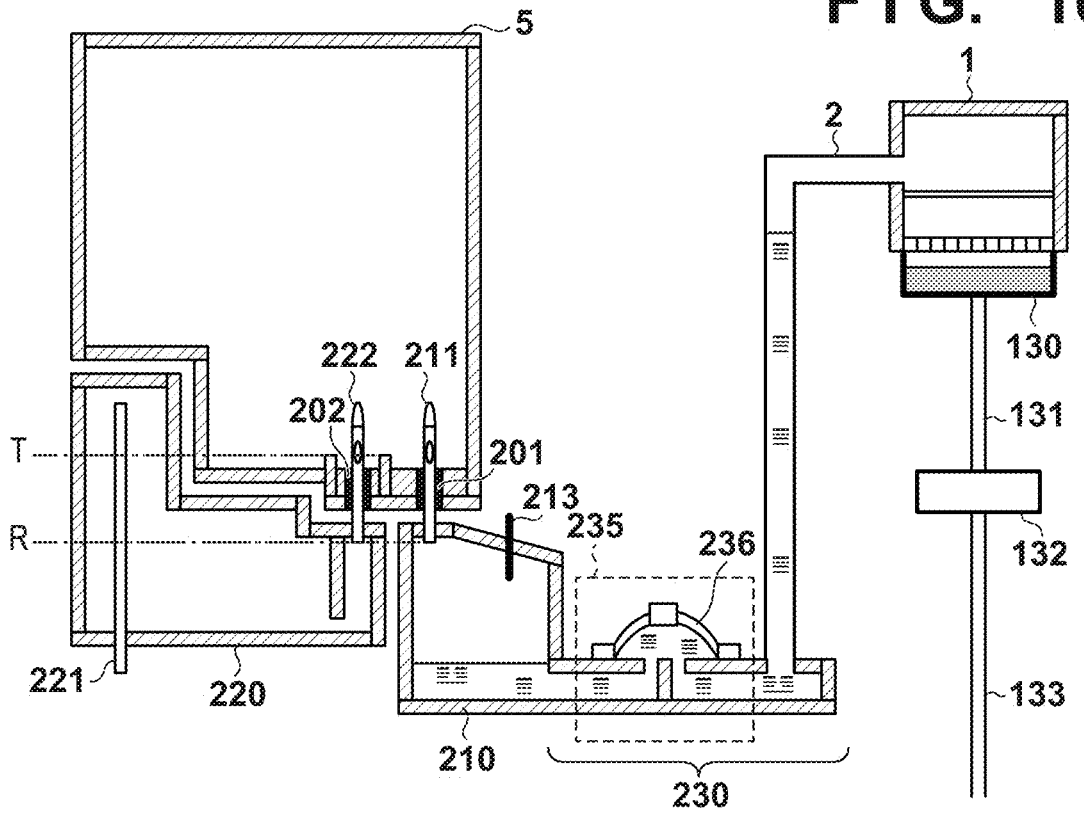

FIG. 10F shows the state of the ink supply subsystem after the suction operation C sequence has been executed from the state shown in FIG. 10E.

Since there is only a little more amount of ink contained than a small amount in the inktank 5, the results of the inktank residual detection and the subtank residual detection both will be residual detection off at the end of the suction operation C sequence. Thus, during the execution of the suction operation C sequence, the suction amount C obtained from the suction operation C will be added again to the subtank counter, and the total value will be double the suction amount C. Note that a value double the suction amount C is larger than the value of SSth described above.

After the end of the suction operation C sequence, the process advances to step S1441, and the value of the counter L is incremented. Subsequently, in step S1450, whether the value of the counter L is equal to or more than 2, that is, whether the suction operation C sequence in step S1440 has been executed twice or more is determined. Here, if L<2, that is, if the suction operation C sequence in step S1440 has been executed once, the process returns to step S1410.

Note that if the process returns to step S1410 in the state as shown in FIG. 10F, since it is determined to be the state of the inktank ink residual detection off and the subtank ink residual detection off, the process will advance to step S1421, and the inktank exchange sequence will be executed. The inktank exchange will be performed here, and the process will return again to step S1410.

Figure 11A:
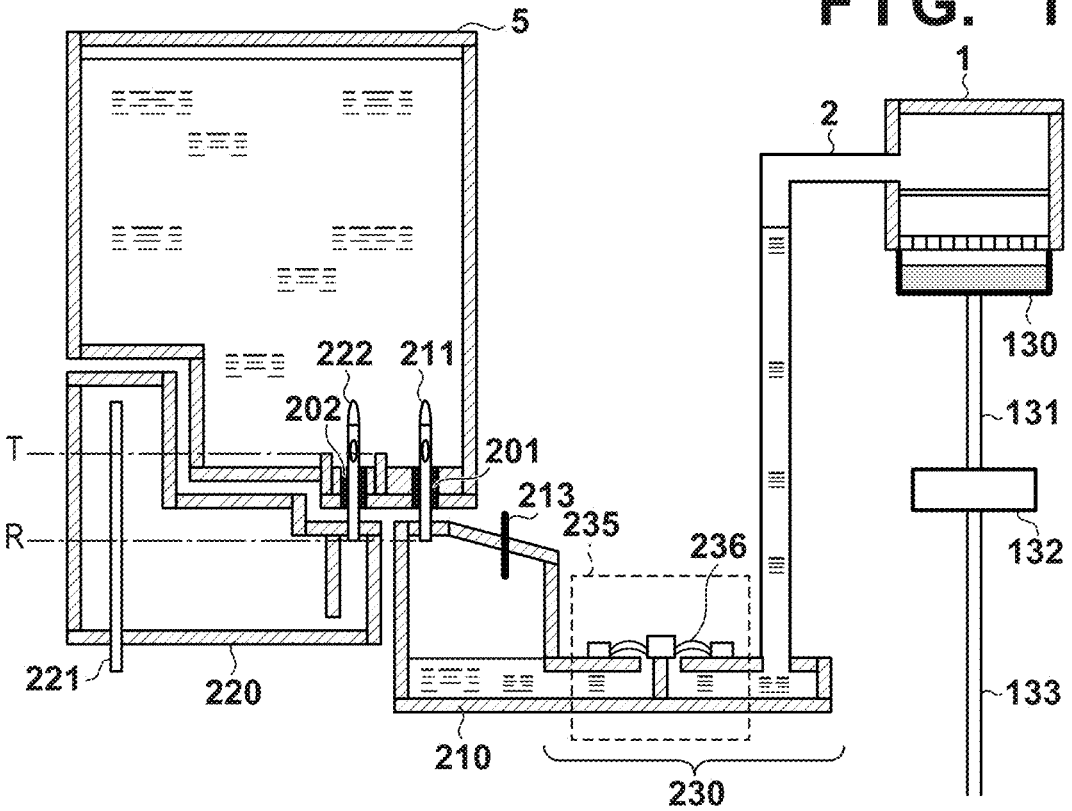
FIGS. 11A, 11B, 11C, and 11D are views showing the changes in the state of the ink supply subsystem corresponding to the initial filling sequence according to the second embodiment.

FIG. 11A shows the state of the ink supply subsystem when the inktank is exchanged with an inktank containing a sufficient amount of ink at the time of the inktank exchange.

If the process returns to step S1410 in the state as shown in FIG. 11A, the residual detection on will be determined as the result of the inktank residual detection, and the process will advance to step S1430. Subsequently, since the count value of the subtank counter is double the suction amount C and is larger than SSth, the determination result will be negative (NO) in step S1430, and the process will advance to step S1431. Subsequently, in step S1431, the subtank filling sequence as described above is executed again. Note that if the suction operation C sequence is executed without executing the subtank filling sequence at this time, bubbles will mix into the supply tube 2 as described above.

Figure 11B:
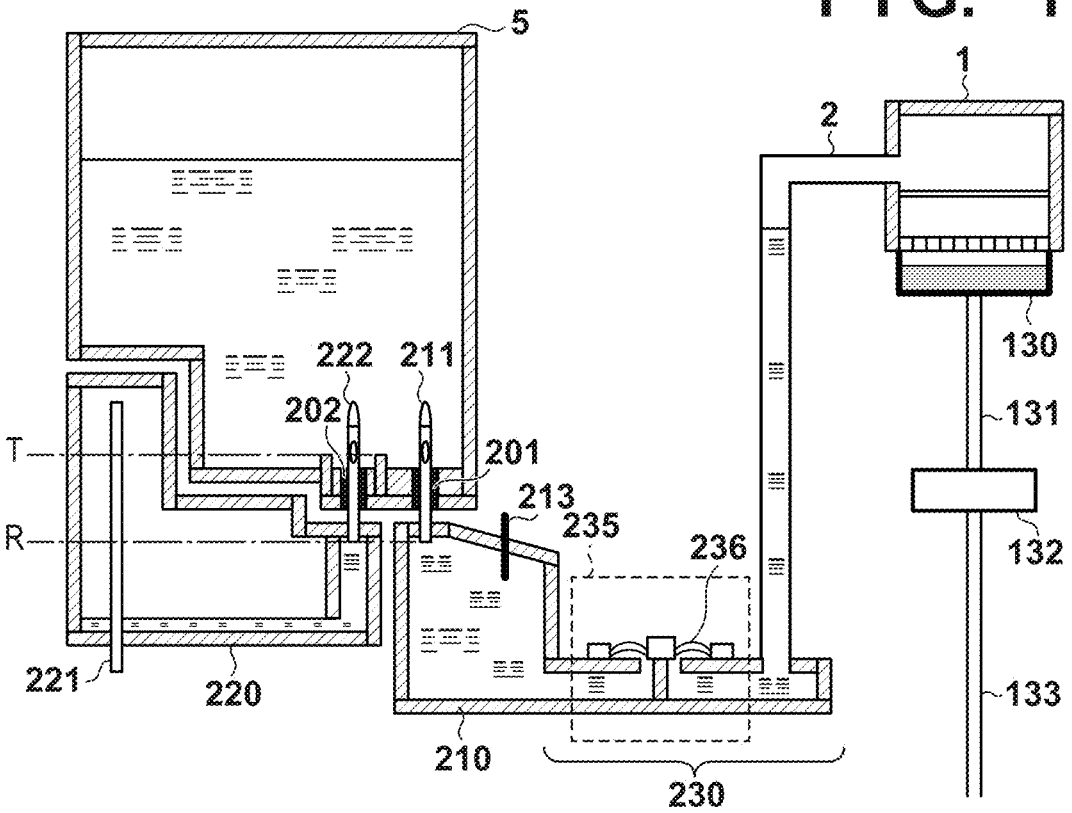

FIG. 11B shows the state of the ink supply subsystem after the subtank filling sequence has been executed from the state as shown in FIG. 11A. Note that after the execution of the subtank filling sequence in step S1431, the count value of the subtank counter will be reset to "0" as described above.

Subsequently, in step S1440, the suction operation C sequence is executed for the third time, and the value of the counter L is incremented in step S1441. In the determination performed in the subsequent step S1450, since L=2, the process advances to step S1451.

Figure 11C:
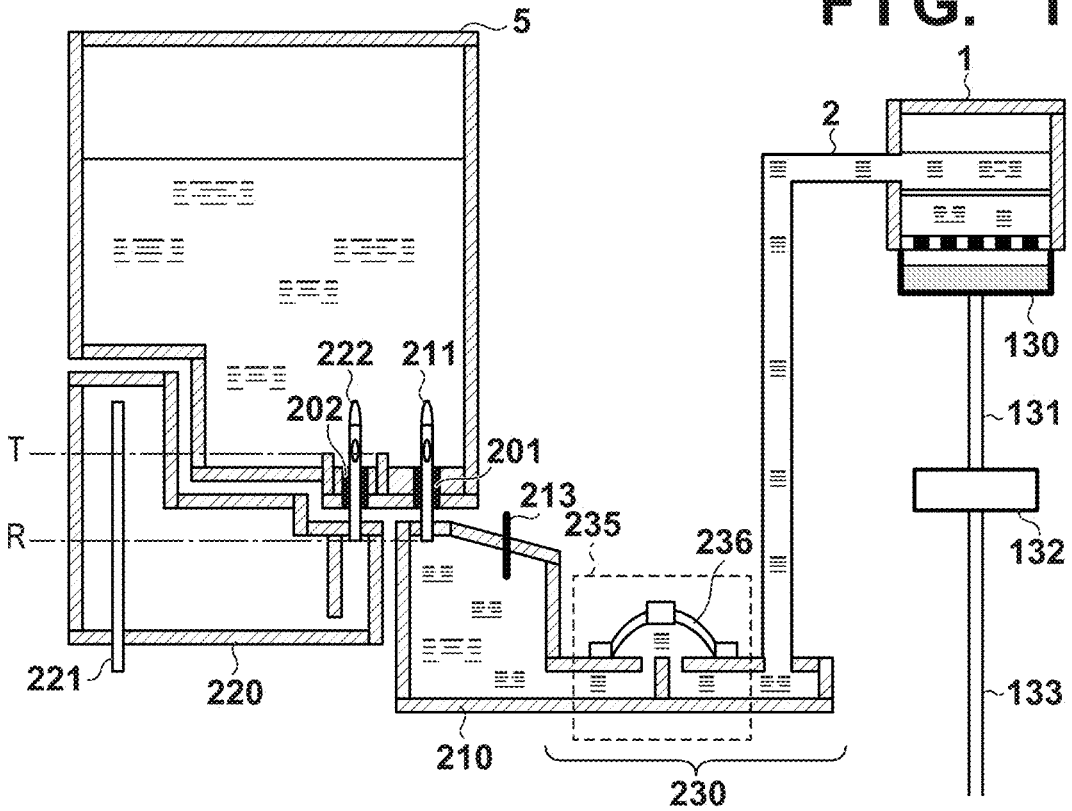

FIG. 11C shows the state of the ink supply subsystem after the suction operation C sequence has been executed from the state as shown in FIG. 11B.

In this case, the ink in the subtank 210 has reached the printhead 1 by executing the suction operation C sequence once in step S1400 and the suction operation C sequence twice in step S1440, that is, by executing the suction operation C sequence three times in total.

The description will continue by referring back to FIGS. 12B to 12C. In step S1451, the valve 235 is closed. This is to eliminate the risk of the "ink falling" described above. In a case in which the above-described "ink falling" has occurred in the subtank filling sequence of step S1431, it is possible that the printhead 1 has not been filled with ink even though the above-described suction operation C sequence has been executed three times. If the printhead 1 has not been filled with ink, there is a possibility that menisci are not formed on the ink orifices of the printhead 1. The "ink falling" may occur if the menisci are not formed on the ink orifices of the printhead 1. The valve 235 is closed in step S1451 to eliminate this risk.

Subsequently, the process advances to step S1452, and a cap close/idle suction operation is executed. More specifically, the driving of the suction pump 132 is started almost simultaneously with the opening of an air valve (not shown) included in the cap 130, and this driving operation is continued for five seconds. The ink in the cap 130 is discharged to the maintenance cartridge (not shown) via a pump tube 131 and a waste ink tube 133 by this cap close/idle suction operation.

Next, in step S1453, the cap 130 is moved to a separation position. Subsequently, in step S1454, a known wiping mechanism (not shown) wipes an ink orifice surface 102 of the printhead 1 and removes foreign substances such as unnecessary ink, dust, and the like on the ink orifice surface 102. Furthermore, in step S1455, a preliminary discharge operation as that described above is executed. More specifically, ink droplets are discharged approximately five hundred times into the cap 130 from all of the ink orifices of the printhead 1. This preliminary discharge operation is performed to improve the ink discharge performance of the printhead 1. Since the valve 235 is closed at this time, ink corresponding to the amount of ink lost from the printhead 1 due to this preliminary discharge operation will not be supplied from the side of the subtank 210. Hence, the absolute value of the negative pressure inside the printhead 1 will rise in correspondence to this amount.

After the end of the preliminary discharge operation, in step S1456, a cap open/idle suction operation is executed by driving the suction pump 132 while keeping the cap 130 positioned in the separation position. The ink that was discharged to the cap 130 by the preliminary discharge operation is discharged to the maintenance cartridge (not shown) via the pump tube 131 and the waste ink tube 133 by the cap open/idle suction operation.

Subsequently, the process advances to step S1460, and the carriage 60 is moved to a position that faces the detection unit 900. Next, the discharge detection is performed in step S1461. More specifically, the presence/absence of ink discharge is determined by causing ink droplets to be discharged from the ink orifices of the printhead 1 to the detection unit 900 and detecting the changes in the light amount received by the light receiving element at that time. Since the valve 235 is closed also at this time, ink corresponding to the amount of ink lost from the printhead 1 due to the ink droplet discharge will not be supplied from side of the subtank 210. Hence, the absolute value of the negative pressure inside the printhead 1 will further rise in correspondence to this amount.

If ink discharge is not confirmed as a result of the discharge detection in step S1461, the process advances to step S1462, and the carriage 60 is returned to a home position (capping position). Subsequently, in step S1463, the cap 130 is moved to the capping position. Subsequently, the process returns to step S1410.

It can be assumed that a state in which the ink discharge cannot be confirmed is a state in which the printhead 1 has not been filled with ink due the influence of the above-described "ink falling" and the like. Hence, in this initial filling sequence, after the processes of steps S1462 and S1463 has been executed, the process will return to step S1410, and the suction operation C sequence will be executed again after the processes of steps S1410 to S1431 has been executed. Furthermore, the discharge detection will be performed again in step S1460 after the execution of the processes of steps S1441 to S1456.

In contrast, if the ink droplet discharge is confirmed in step S1461, the process advances to step S1465. In step S1465, the carriage 60 is returned to the home position. Subsequently, in step S1466, the cap 130 is moved to the capping position.

Subsequently, in the process of step S1470, the inktank residual detection is executed, and its result is determined. If the result is determined to be the residual detection off (NO) here, the process advances to step S1480. In step S1480, the subtank residual detection is executed, and its result is determined. If this result is also determined to be the residual detection off (NO) here, the process advances to step S1481, and the inktank exchange sequence described above will be executed. Subsequently, the process returns to step S1470, and the inktank residual detection is executed again.

In a case in which the result of the subtank residual detection in step S1480 is determined to be residual detection on (YES), the process advances to step S1500, and a suction operation V sequence (to be described below) will be executed. That is, even if the result of the inktank residual detection in step S1470 is determined to be the residual detection off, if the result of the subtank residual detection in step S1480 is determined to be the residual detection on, the process advances to step S1500. In step S1500, since the suction operation V sequence (to be described later) will be executed, the aforementioned problem of a small amount of ink remaining in the inktank to be exchanged is also prevented at this time.

In addition, in a case in which the result of the inktank residual detection in step S1470 is determined to be the residual detection on, the process advances to step S1490. In step S1490, the subtank residual detection is executed, and its result is determined. If the result is determined to be the residual detection off here, the process advances to step S1491, and the subtank filling sequence will be executed. At this time, since the ink discharge from the ink orifices of the printhead 1 has been confirmed, that is, since the formation of the menisci on the ink orifices of the printhead 1 has been confirmed, there is no risk of the above-described "ink falling" occurring. Hence, if the state of the inktank ink residual detection on and the subtank ink residual detection off is determined, the subtank filling sequence is executed regardless of the count value of the subtank counter.

On the other hand, if the result of the subtank residual detection in step S1490 is determined to be residual detection on, the process advances to step S1500. That is, in the state of the inktank ink residual detection on and the subtank ink residual detection on, the process advances to step S1500 without any further processes, and the suction operation V sequence (to be described later) is executed.

Since the state shown in FIG. 11C is the state of the inktank ink residual detection on and the subtank ink residual detection on, the suction operation V sequence (to be described later) is executed without any operation.

In step S1500, the suction operation V sequence is executed.

Figure 15:
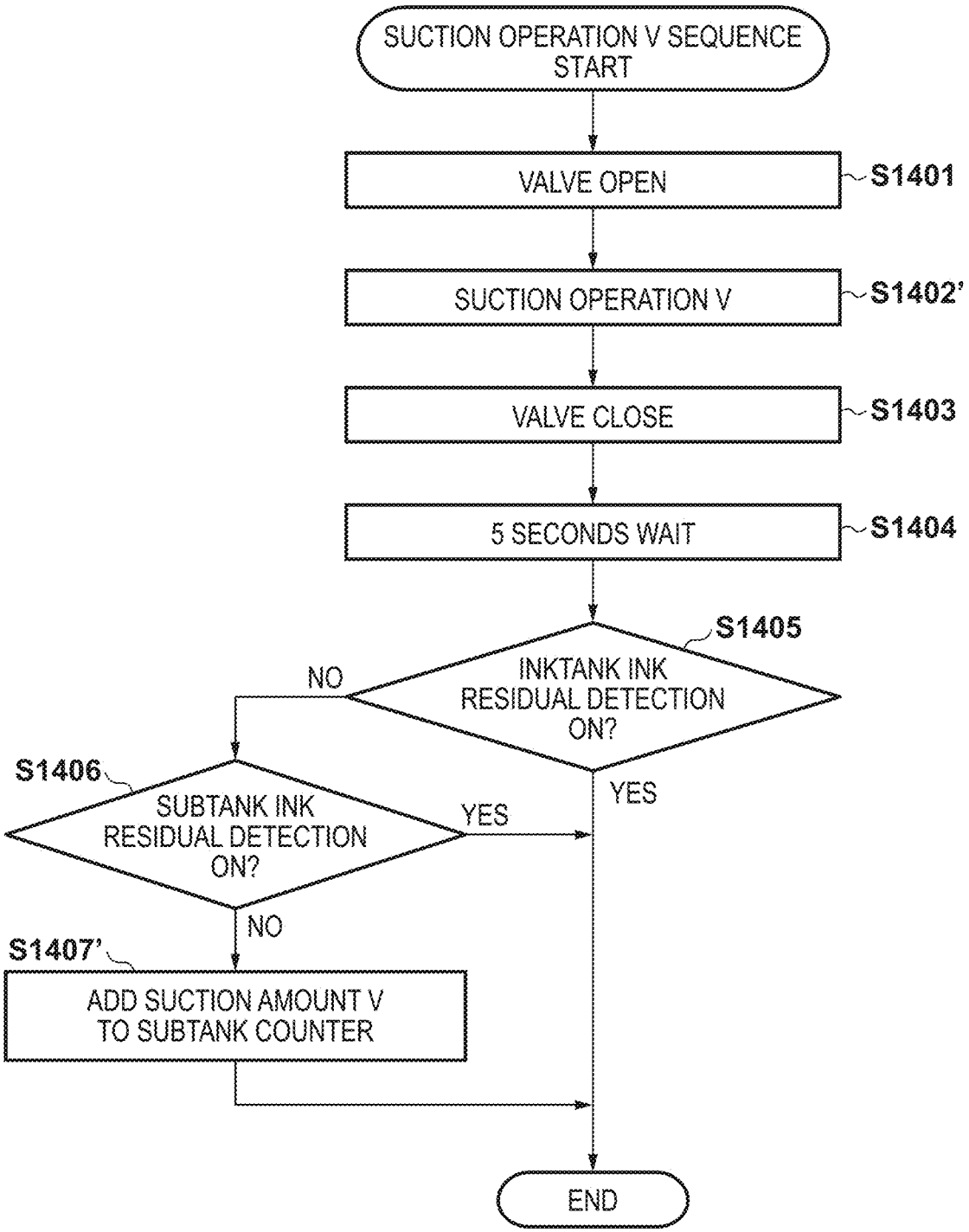
FIG. 15 is a flowchart showing a suction operation V sequence according to the second embodiment.

FIG. 15 is a flowchart showing the details of the suction operation V sequence. Note that in FIG. 15, the step reference numerals denote the processing steps which are the same as those in the processes of the suction operation C in FIG. 14, and its description will be omitted. As is obvious from comparing FIGS. 15 and 14, the suction operation V sequence is a sequence obtained simply by replacing the suction operation C in step S1402 with a suction operation V in step S1402' and the suction amount C in step S1407 with a suction amount V in step S1407'. Note that in the suction operation V, the suction pump 132 is driven for forty seconds.

Figure 11D:
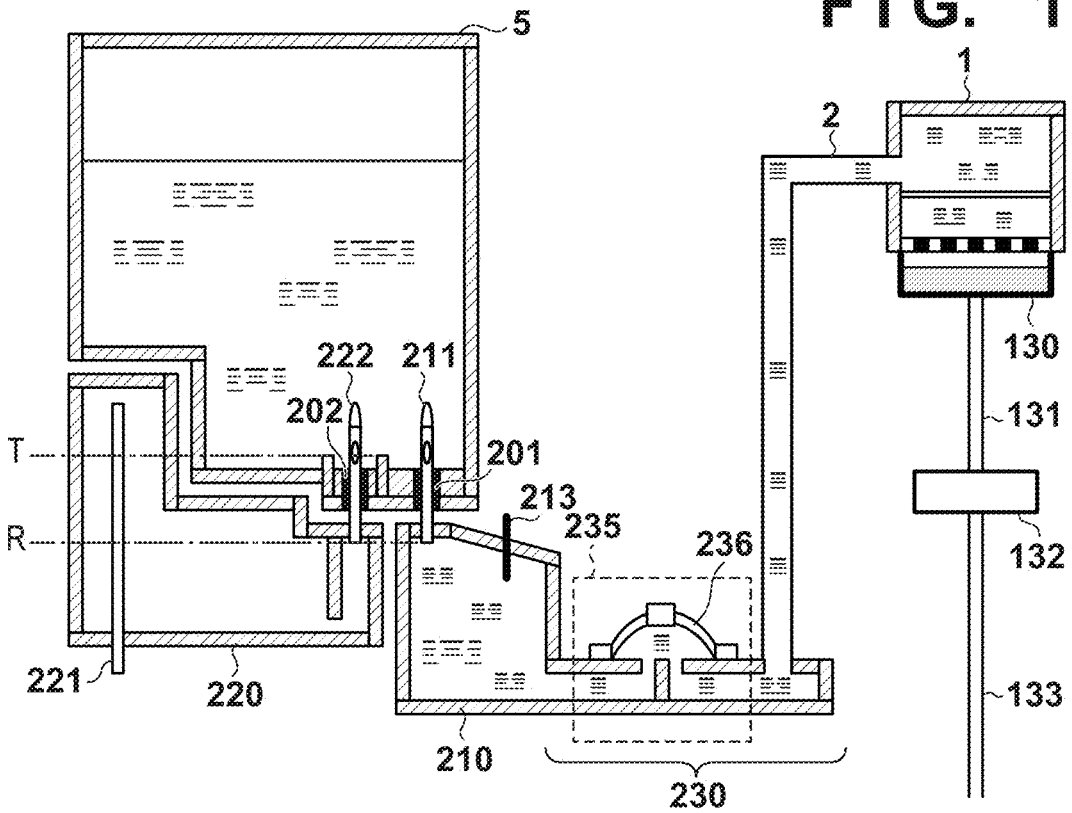
Figure 12A:
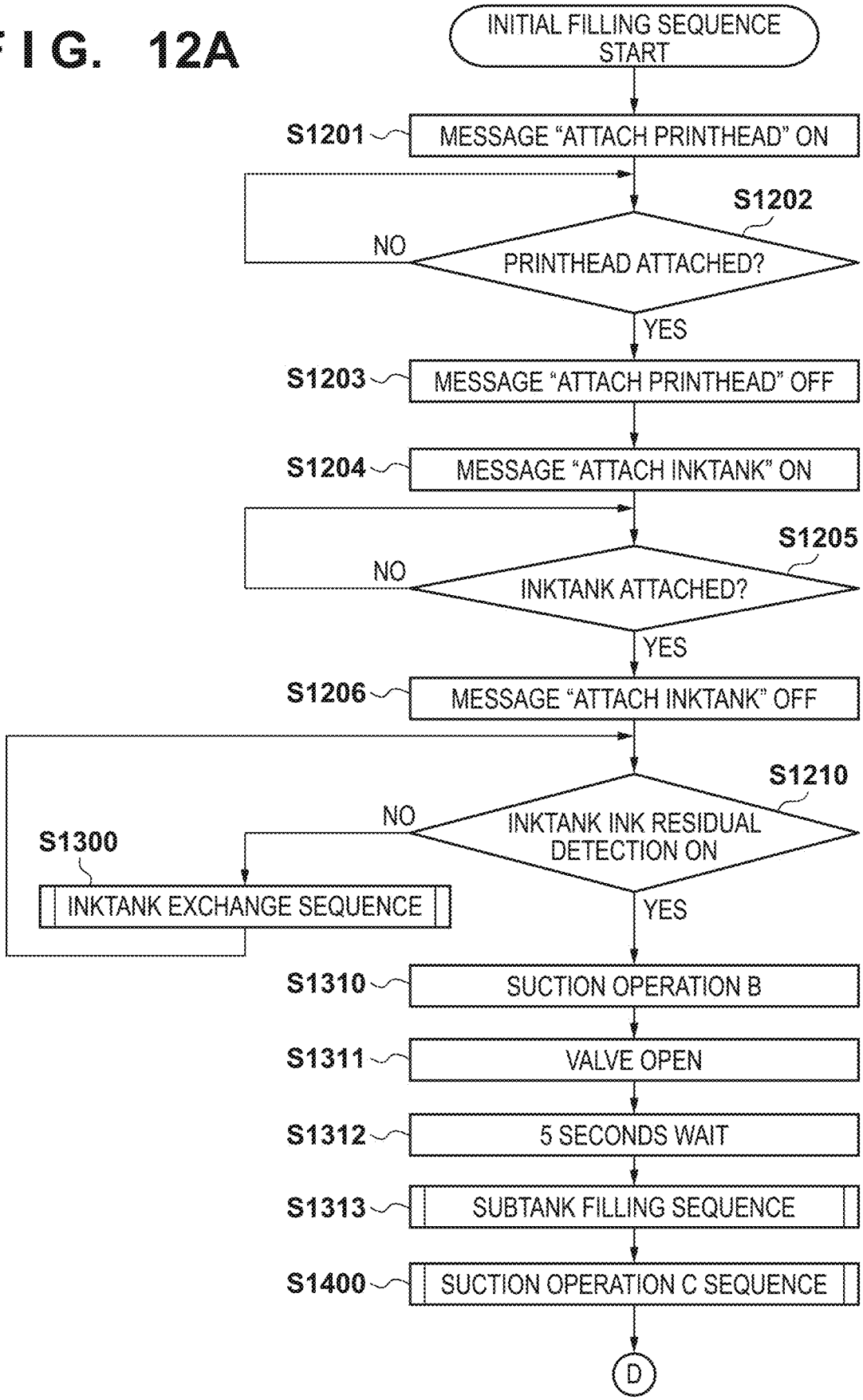
FIGS. 12A, 12B, and 12C are flowcharts showing the initial filling sequence according to the second embodiment.
Figure 12B:
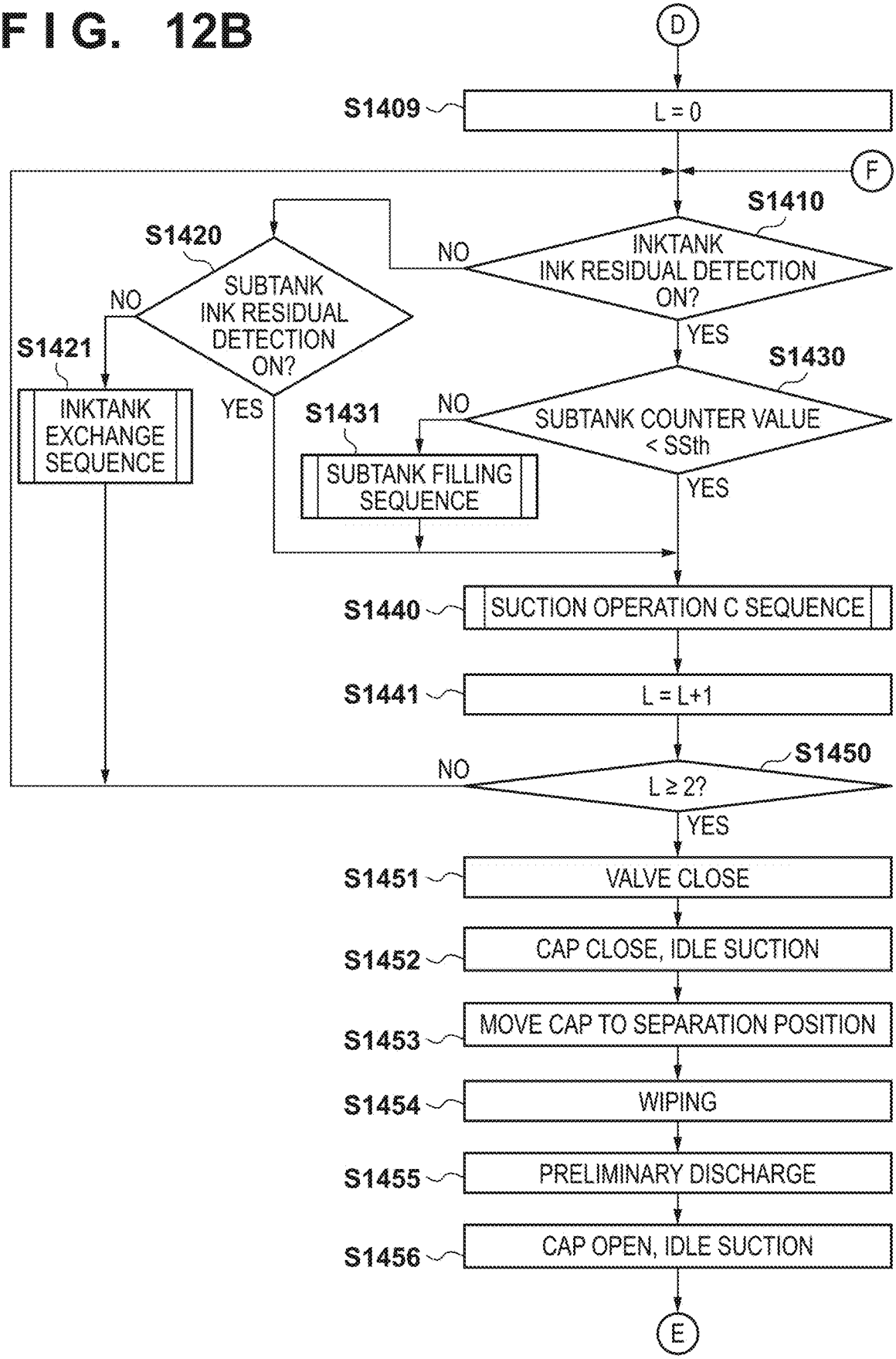
Figure 12C:
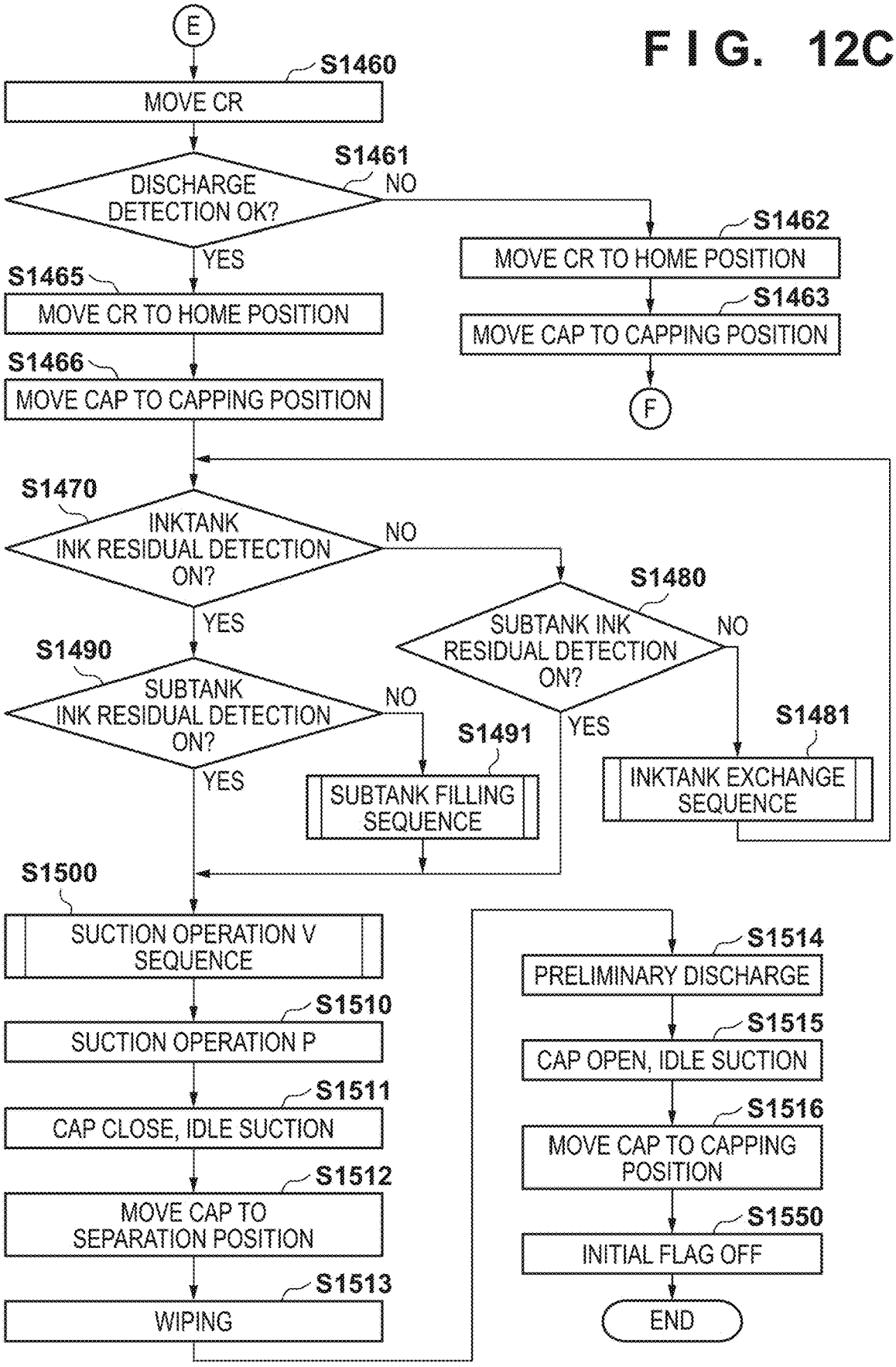

FIG. 11D shows the state of the ink supply subsystem after the suction operation V sequence has been executed from the state as shown in FIG. 11C. Since the choke suction operation is executed in the suction operation V instead of the suction operation performed in a state in which the valve 235 is open as that in the suction operation A sequence described in the first embodiment, the amount of ink contained in the printhead 1 can be greatly increased.

The description will continue by referring back to FIG. 12C. After the completion of the process of step S1500, the process advances to step S1510, and a suction operation P is executed. More specifically, the suction pump 132 is driven for two seconds. Note that the suction operation P refreshes the ink in the ink orifices of the printhead 1.

Subsequently, in the process of step S1511, the cap close/idle suction operation described above is executed, and the ink in the cap 130 is discharged to the maintenance cartridge (not shown) via the pump tube 131 and the waste ink tube 133.

Subsequently, the same processes as those of steps S1453 to S1456 are executed in steps S1512 to S1515 for the same purpose. Subsequently, the process advances to step S1516 and the cap 130 is moved to the capping position.

Finally, in step S1550, the initial flag is set to OFF, and the initial filling sequence ends.

As described above, the initial filling sequence ends after using the detection unit 900 to confirm that an ink filling has been completed up to at least the ink orifices and subsequently executing the suction operation V sequence to fill the printhead 1 with a sufficient amount of ink. Note that the initial flag is set to ON before the printing apparatus is shipped.

Hence, according to the second embodiment described above, in the initial filling sequence, in a case in which there is a sufficient amount of ink in the subtank, the suction operation for filling the ink supply path with ink can be executed even when there is no ink in the inktank. As a result, it can minimize, as much as possible, the occurrence of a case in which a small amount of ink will remain in the inktank to be exchanged. On the other hand, in a case in which the amount of ink in the subtank is insufficient, the suction operation for filling the ink supply path with ink is executed after the amount of ink in the subtank is made sufficient by executing the subtank filling sequence. This prevents bubbles from mixing into the ink supply path.

In addition, although an inkjet printing apparatus that uses one type of ink was exemplified in the first and second embodiments described above, the present invention is not limited to this. The present invention is applicable to, for example, an inkjet printing apparatus that discharges a plurality of types of inks.

Furthermore, although a printhead with an arrangement that includes an electrothermal transducer in each ink orifice as a printing element was used in the first and second embodiments described above, the present invention is not limited to this. For example, a printhead with an arrangement that includes electromechanical transducers (piezoelectric elements) as the printing elements may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2018-014115, filed Jan. 30, 2018, and 2019-002777, filed Jan. 10, 2019, which are hereby incorporated by reference herein in their entirety.

What is claimed is:

1. An inkjet printing apparatus comprising:

a detachable inktank which contains ink;

a subtank which contains the ink supplied from the inktank;

a printhead configured to discharge the ink supplied from the subtank;

an ink supply path which connects the subtank to the printhead;

a supply unit configured to supply the ink from the inktank to the subtank;

a suction unit configured to suck the ink from the printhead by driving a suction pump;

a detection unit configured to detect whether an amount of ink contained in the subtank is larger than a predetermined amount; and a control unit configured to control, after the inktank is attached, the supply unit to supply the ink from the inktank to the subtank until the detection unit detects that the amount of ink contained in the subtank is larger than the predetermined amount, and to subsequently control the suction unit to operate to supply the ink from the subtank to the printhead via the ink supply path.

2. The apparatus according to claim 1, wherein the supply unit includes a valve, whose capacity is variable, being arranged on the ink supply path.

3. The apparatus according to claim 2, wherein the supply unit changes the valve from an open state to a closed state to cause air in the subtank to flow out to the inktank and changes the valve from the closed state to the open state to cause the ink in the inktank to flow into the subtank.

4. The apparatus according to claim 2, wherein the suction unit further includes:

a cap that covers an orifice surface of the printhead, wherein the suction pump is configured to suck an interior of the cap in a state in which the orifice surface is covered by the cap.

5. The apparatus according to claim 4, wherein the suction unit drives the suction pump when the valve is in a closed state, and subsequently switches the valve to an open state to cause the ink to move from the subtank to the printhead.

6. The apparatus according to claim 5, wherein the control unit opens an air communication valve arranged on the cap after causing the suction unit to perform a suction operation for a predetermined number of times, and further causes the suction unit to perform the suction operation.

7. An ink filling method of an inkjet printing apparatus that includes a detachable inktank which contains ink, a subtank which contains the ink supplied from the inktank, a printhead configured to discharge the ink supplied from the subtank, an ink supply path which connects the subtank to the printhead, and a detection unit configured to detect whether an amount of ink contained in the subtank is larger than a predetermined amount, the method comprising:

performing, after the inktank is attached, first ink filling of supplying the ink from the inktank to the subtank until the detection unit detects that the amount of ink contained in the subtank is larger than the predetermined amount; and performing, after the first ink filling, second ink filling of supplying the ink from the subtank to the printhead via the ink supply path by sucking the ink from the printhead by driving a suction pump.

8. An inkjet printing apparatus comprising:

a detachable inktank which contains ink;

a subtank which contains the ink supplied from the inktank;

a printhead configured to discharge the ink supplied from the subtank;

an ink supply path which connects the subtank to the printhead;

a supply unit configured to include a valve, whose volume is variable, being arranged on the ink supply path, and configured to supply the ink from the inktank to the subtank by varying the volume of the valve;

a suction unit configured to perform a suction operation of sucking the ink from the printhead by driving a suction pump;

a first detection unit configured to detect whether an amount of the ink contained in the inktank is or is not less than a first threshold value;

a second detection unit configured to detect whether an amount of the ink contained in the subtank is or is not less than a second threshold value; and a control unit configured to control the suction unit to perform the suction operation in a case in which the first detection unit detects that the amount of ink contained in the inktank is less than the first threshold value and the second detection unit detects that the amount of ink contained in the subtank is not less than the second threshold value.

9. The apparatus according to claim 8, wherein in a case in which the first detection unit detects that the amount of ink contained in the inktank is less than the first threshold value and the second detection unit detects that the amount of ink contained in the subtank is less than the second threshold value, the control unit prompts a user to exchange the attached inktank.

10. The apparatus according to claim 9, further comprising:

a display unit configured to display a message to prompt the user to exchange the inktank.

11. The apparatus according to claim 10, wherein in a case where the inktank has been exchanged in response to the displayed message, the control unit sets the display of the message displayed by the display unit to OFF.

12. The apparatus according to claim 8, wherein the supply unit varies the volume of the valve by opening and closing the valve.

13. The apparatus according to claim 12, wherein the supply unit changes the valve from an open state to a closed state to cause air in the subtank to flow out to the inktank and changes the valve from the closed state to the open state to cause the ink in the inktank to flow into the subtank.

14. The apparatus according to claim 13, wherein the suction unit includes:

a cap that covers an orifice surface of the printhead, wherein the suction pump is configured to suck an interior of the cap in a state in which the orifice surface is covered by the cap.

15. The apparatus according to claim 8, wherein the second threshold value is an approximately maximum amount of ink containable in the subtank.

* * * * *